US006663219B2

(12) United States Patent
Kubota et al.

(10) Patent No.: US 6,663,219 B2
(45) Date of Patent: Dec. 16, 2003

(54) INKJET RECORDING APPARATUS

(75) Inventors: Hidemi Kubota, Tokyo (JP); Masayoshi Tachihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 56 days.

(21) Appl. No.: 09/870,663

(22) Filed: Jun. 1, 2001

(65) Prior Publication Data

US 2002/0033860 A1 Mar. 21, 2002

(30) Foreign Application Priority Data

Jun. 1, 2000 (JP) ..... 2000-164596
Jun. 29, 2000 (JP) ..... 2000-196224

(51) Int. Cl.[7] ..... B41J 2/165
(52) U.S. Cl. ..... 347/36; 347/35
(58) Field of Search ..... 347/36, 35, 31, 347/29, 40, 47, 54; 216/16, 17

(56) References Cited

U.S. PATENT DOCUMENTS 4,789,425 A * 12/1988 Drake et al. ..... 216/16
5,428,380 A * 6/1995 Ebisawa ..... 347/12
6,193,355 B1 * 2/2001 Nakamura ..... 347/30
6,299,279 B1 * 10/2001 Asada ..... 347/31

FOREIGN PATENT DOCUMENTS

EP 1 002 648 A1 5/2000
JP 5-261938 10/1993
JP 9-30004 2/1997
JP 9-290539 11/1997
JP 2000-177146 6/2000

* cited by examiner

*Primary Examiner*—Shih-Wen Hsieh
(74) *Attorney, Agent, or Firm*—Fitzpatrick, Cella, Harper & Scinto

(57) ABSTRACT

In an inkjet recording apparatus, a head unit composed of a recording head and a ink tank is mounted on a carriage with an ejection port surface facing upward. The recording head records an image on a lower surface of a medium to be recorded by ejecting ink upward from ejecting ports. A preliminary ejection receiver is disposed outside of a region where an image can be recorded on the medium to be recorded to receive ink preliminarily ejected from the recording head in order to maintain and recover an ink ejection performance of the recording head. The preliminary ejection receiver has an opening acting an inlet for the preliminarily ejected ink. Further, a ceiling surface, which inclines with respect to a horizontal direction and on which the ink preliminarily ejected into the preliminary ejection receiver deposits, is disposed above the opening. With this arrangement, ink ejected into the preliminary ejection receiver is prevented from leaking from the opening.

23 Claims, 16 Drawing Sheets

INKJET RECORDING APPARATUS

BACKGROUND OF THE INVENTION

1. Field of the Invention

The present invention relates to an inkjet recording apparatus for executing recording on a medium by ejecting ink droplets onto the medium and depositing the ink droplets thereon, and more particularly, to an inkjet recording apparatus for ejecting ink in a direction opposite to the direction of gravity.

2. Description of the Related Art

Recent developments in personal computers have caused remarkable technical innovations in recording technologies used in output apparatuses for personal computers. Among these recording technologies, inkjet recording is spotlighted as a technology used in an output apparatus for outputting not only characters but also images, and in particular, images such as photographs for which multigradation, multi-color, and high resolution are required.

Inkjet recording apparatuses print characters or create an image by outputting electric signals based on image information, ejecting a minute amount of ink droplets from nozzles, which are disposed in great numbers ordinarily, on demand through an electro-dynamic transducer, and depositing the ink droplets onto a medium such as a paper and the like.

Known well among these inkjet recording apparatuses is a recording apparatus which ejects ink in a direction along the gravity direction, that is in a downward direction and a recording apparatus which injects ink in a vertical direction normal to the gravity direction.

FIG. 1 is a sectional view showing a main portion of a conventional inkjet recording apparatus. In this recording apparatus, an inkjet recording head is arranged so as to eject ink in a direction along the gravity direction, that is, in a downward direction.

In the inkjet recording apparatus shown in FIG. 1, a recording head 101 and an ink tank 102 are mounted on a carriage 103, wherein the recording head 101 ejects ink onto an upper surface of a medium M and forms an image thereon, and the ink tank 102 accommodates ink to be supplied to the recording head 101. The carriage 103 is supported by two sliding shafts 105*a* and 105*b* and reciprocated by a carriage drive motor (not shown) through a timing belt (not shown) in a direction (vertical to the figure) which is normal to a direction in which the medium M is transported (right to left direction on the figure).

A head fixing cover 104 is mounted on the carriage 103 so that the recording head 101 can be fixed on the carriage 103 with a high degree of precision.

Note that these two sliding shafts 105*a* and 105*b* support the carriage 103 and determine a scanning direction thereof as well as regulate a distance between an ink ejecting port surface 101*a* of the recording head 101 and the medium M facing the ink ejecting port surface 101*a* to permit an image of high accuracy to be formed on the medium M.

As the carriage 103 moves, the inkjet recording apparatus creates an image for each one scan on the upper surface of the medium M by ejecting ink from the recording head 101 during reciprocating movement of the recording head 101 while alternately repeating the movement of the recording head 101 and transportation of the medium M at a each predetermined pitch.

A pair of sheet feed rollers 106*a* and 106*b*, which constitute a transportation unit for transporting the medium M, are disposed upstream of the carriage 103 with respect to a transporting direction of the medium M. The medium M is supplied between the sheet feed rollers 106*a* and 106*b* from an auto-sheet-feeder (not shown) or a cassette (not shown) mounted on the recording apparatus. Note that the sheet feed roller 106*b* is driven by a drive unit (not shown) through a drive gear 107.

A guide member (not shown) is disposed downstream of the sheet feed rollers 106*a* and 106*b* with respect to the transporting direction of the medium M. The guide member prevents the ink ejecting port surface 101*a* from coming into contact with the medium M by preventing floating and twisting of the medium M at a position where it faces the ink ejecting port surface 101*a*. In addition to the above, the guide member keeps a distance between the ink ejecting port surface 101*a* and the upper surface of the medium M constant, thereby maintaining a position where ink reaches the medium M at a high degree of precision.

Further, a pair of sheet discharge rollers 108*a* and 108*b* are disposed downstream of the carriage 103 with respect to the transporting direction of the medium M. When the medium M arrives between the sheet discharge rollers 108*a* and 108*b*, it is further transported mainly by the sheet discharge rollers 108*a* and 108*b* thereafter, and the medium M, on which an image is created by the recording head 101, is discharged to the outside of the recording apparatus.

It is known in recording by inkjet that execution of preliminary ejection is an effective means for achieving stable recording. A preliminary ejection receiver (which also is referred to as an ejection without ink receiver) has the function of receiving ink that is ejected from a recording head at a predetermined position outside the region where recording can be executed to a medium, prior to a recording operation and for supplying the thus received ink to a waste ink processing system.

While there are several reasons why this arrangement is necessary, one particular reason is to discharge ink which is condensed in nozzles when a recording apparatus is not used for a long period.

When a recording operation is resumed after the recording apparatus is brought to rest for a long time, ink condensed at positions near to ejecting ports of nozzles is ejected first, and then ink in the interiors of the nozzles and ink from an ink supply system located rearward of the nozzles are gradually ejected. An image recorded at that time is such that a beginning portion of the image has a deep tone, and an intrinsic tone of the ink is gradually reproduced toward a rear portion thereof, which results in an uneven tone. In particular, when uniform half-tones of 50%, 25% and the like which are adjacent each other are recorded on a white medium, a portion having a deep tone is formed first on the medium to be recorded and the tone becomes lighter toward a rear portion thereof, which makes irregularity of tone particularly conspicuous on the medium to be recorded.

To prevent occurrence of the above problem, an image is usually formed on a medium M after ink condensed in nozzles is discharged using a preliminary ejection receiver (ejection without ink receiver) as described above.

In FIG. 1, a preliminary ejection receiver 109 for receiving ink preliminarily ejected from the recording head 101 is disposed with its opening facing a direction opposite to the gravity direction, that is, in an upward direction. In the recording apparatus, the preliminary ejection receiver 109 is disposed outside a region, where recording can be executed by the recording head 101 to the medium M. More specifically, the preliminary ejection receiver 109 is disposed at a position in the vicinity of a terminal end in a moving region of the carriage 103 which moves along the sliding shafts 105*a* and 105*b*. As a result, when the carriage 103 moves to the terminal end, the ink ejecting port surface 101*a* of the recording head 101 mounted on the carriage 103 faces the opening of the preliminary ejection receiver 109. Note that an absorption body 110 is disposed in the preliminary ejection receiver 109 to hold the preliminarily ejected ink.

A waste ink absorption body 111 and a waste ink holding member 112 are disposed in the inkjet recording apparatus below the above respective arrangements to cope with a case in which ink accidentally drops from the recording head 101.

As described above, in a downward printing type recording apparatus, a preliminary ejection receiver is disposed below a recording head with its opening facing upward, and ink ejected into the preliminary ejection receiver drops downward due to gravity and is stored on a bottom portion. As a result, in the downward ejection type recording apparatus, no problem occurs as to accommodation of ink, which is ejected from a recording head into the preliminary ejection receiver, and no special device is necessary except provision of a drain for collecting waste ink.

As is apparent from the above explanation, it is preferable in an inkjet recording apparatus to eject ink in a downward direction along the gravity direction. This is because when problems arise in the recording apparatus, deposition of ink on an ink ejecting port forming surface of a recording head and on an electric circuit, contacts, and the like, which realize ejection of ink from nozzles, is prevented and occurrence of a greater problem can be avoided, because this arrangement permits ink to drop downward from the nozzles.

Another advantage of the downward ejection type inkjet recording apparatus is in that preliminarily ejected ink can be easily collected because ink received by the preliminary ejection receiver 109 is dropped downward by gravity and collected in the bottom portion. Still another advantage of this type of the recording apparatus is that, even if ink is ejected to the medium M in a large amount, it is difficult for the ink to flow downward therefrom because a recording surface of the medium M faces upward.

However, in the recording head arranged to eject ink downward along the gravity direction, ink paths in the nozzles must be kept at a pressure lower than atmospheric pressure (i.e., negative pressure) so that ink does not drop unintentionally from nozzles of a recording head during a recording operation. Various systems are employed as a means for generating the negative pressure. One simple system is arranged such that a soft tube having no ventilating property is connected to a recording head at an end thereof and used as an ink supply path, an ink bag or the like is connected to the other end of the tube, and the ink bag is located at a position lower than ink ejecting ports in a recording apparatus. As a further example, there is a system having a head unit replaceably mounted on a carriage, wherein the head unit includes a recording head provided with ink ejecting ports and an ink storing unit which are arranged integrally each other, and the ink storing unit generates a negative pressure by impregnating a porous ink absorbing member with ink to be ejected. In this case, in the downward ejection type inkjet recording apparatus, since the ink tank 102 is disposed above the ink ejecting port surface 101*a* of the recording head 101, when a negative pressure in the ink tank 102 is reduced even slightly, the negative pressure in the ink tank 102 is liable to be made unstable when the recording head 101 moves, and ink is liable to flow downward from an extreme end of the recording head 101. Thus, to stabilize the negative pressure in the ink tank 102, a structure of an ink path in the ink tank 102, e.g., the position, size, and density of the absorption body, are variously devised, which increases complexity of a structure of the ink tank 102.

In the downward ejection type inkjet recording apparatus, a recording surface of a medium M faces upward. Thus, when recording is executed to a plurality of mediums M, they are outputted with pages ordered reversely unless they are discharged upside down by being U-turned after recording has been completed.

To solve problems of the generation of the negative pressure and reverse stacking of sheets as described above, there is proposed to employ an upward ejection type recording apparatus for ejecting ink in an upward direction which is opposite to the gravity direction.

When the upward ejection type recording apparatus is employed, no special device is necessary to generate a negative pressure because an ink ejecting port forming surface of a recording head is located above a liquid level of ink to be supplied.

Furthermore, the upward ejection type recording apparatus can realize face down recording in which a recording surface of a medium faces downward, which permits the medium to be outputted, even if recording is executed to a plurality of mediums, with a proper order of pages even if it is not discharged upside down.

In addition to the above-mentioned, it is also possible to provide an arrangement capable of, for example, simultaneously executing printing on both surfaces of a medium to be recorded using recording heads for ejecting ink downward and upward at the same time.

It is necessary to execute preliminary ejection even in the recording apparatus for ejecting ink in the upward direction against the gravity direction in order to stabilize recording.

In this case, a preliminary ejection receiver is disposed above a recording head with an opening facing downward. When the preliminary ejection receiver of the downward ejection type recording apparatus is used as it is in the upward ejection type recording apparatus, ink ejected toward a ceiling surface of the preliminary ejection receiver drops therefrom due to gravity or flows downward along a wall surface and returns toward the opening again. In a worst case, the ink returned to the opening drops to the outside of the preliminary ejection receiver from the opening and pollutes an ink ejecting port forming surface of the recording head and an interior of the recording apparatus. There is also a possibility of such problems as short circuit of electric contacts of the recording head, and the like.

In an arrangement of the conventional preliminary ejection receiver, a mechanism for collecting waste ink resulting from preliminary ejection and a place where the waste ink is stored are necessary, which makes the recording apparatus itself complex and increases its size.

SUMMARY OF THE INVENTION

Accordingly, it is an object of the present invention, which was made in view of the above problems, to provide an inkjet recording apparatus capable of preventing ink ejected into a preliminary ejection receiver from leaking from an opening as well as capable of simplifying an arrangement of the recording apparatus and reducing a size of the apparatus.

To achieve the above object, in an inkjet recording apparatus of the present invention including a preliminarily ejected ink receiver for receiving ink ejected in preliminary ink ejection which is executed to maintain and recover an ink ejection performance of a recording head for recording an image on a medium by ejecting ink from ejecting ports in an upward direction which is a direction against the gravity direction and which does not contribute to recording, the inkjet recording apparatus is characterized in that the preliminarily ejected ink receiver includes an opening and an ink leakage prevention mechanism, the opening acting an inlet of the preliminarily ejected ink, and the ink leakage prevention mechanism preventing the ink preliminarily ejected into the preliminarily ejected ink receiver from leaking from the opening to the outside of the preliminarily ejected ink receiver along the gravity direction.

Further, in an inkjet recording apparatus of the present invention including a preliminarily ejected ink receiver for receiving ink ejected in preliminary ink ejection which is executed to maintain and recover an ink ejection performance of a recording head for recording an image on a medium by ejecting ink from ejecting ports in an upward direction which is a direction against the gravity direction and which does not contribute to recording, the inkjet recording apparatus is characterized in that the recording head is disposed obliquely with respect to the preliminarily ejected ink receiver associated therewith.

According to the inkjet recording apparatus of the preliminary ejection receiver, ink preliminarily ejected into the preliminary ejection receiver from the recording head through the opening is prevented from leaking to the outside of the preliminary ejection receiver from the opening thereof. Thus, it is possible to prevent an ink ejecting port forming surface of the recording head and the interior of the recording apparatus from being polluted with the ink.

It is preferable that the ink leakage prevention unit be composed of a ceiling member which inclines with respect to a horizontal direction. Ink which is preliminarily ejected into the preliminary ejection receiver from the recording device through the opening deposits on the ceiling member. According to this arrangement, the ink which is preliminarily ejected into the preliminary ejection receiver and deposited on the ceiling member flows downward along the ceiling member due to gravity. Thus, it is possible to discharge the preliminarily ejected ink to the outside of the preliminary ejection receiver without directing the ink toward the opening.

Further, a plurality of grooves may be formed on a surface of the ceiling member along the inclining direction of the ceiling member. According to this arrangement, since the grooves generate a capillary force, they can cause the preliminarily ejected ink to flow along the ceiling member without dropping the ink downward after they capture the ink. As a result, leakage of ink from the opening can be more reliably prevented.

A projection projecting upward may be disposed around an edge of the opening of the preliminary ejection receiver. With this arrangement, even if the preliminarily ejected ink drops from the ceiling member around a periphery of the opening, the ink is dammed around the periphery of the opening by the projection. Thus, there is no possibility that the ink leaks to the outside of the preliminary ejection receiver by passing through the opening.

An ink absorption body may be disposed around the edge of the opening of the preliminary ejection receiver, which can more effectively prevent drop and leakage of ink from the opening.

The preliminary ejection receiver may include an ink discharge unit for discharging ink accommodated therein to the outside of the preliminary ejection receiver. The ink absorbing body may be continuously formed in the ink discharge unit and the preliminary ejection receiver.

The inkjet recording apparatus may include a carriage on which the recording head is mounted and which is scanned with respect to the medium. A preliminarily ejected ink receiver is disposed at a position which is located outside a region where an image can be recorded on the medium and which faces an ink ejecting port surface of the recording head having been moved outside the region by the carriage.

The preliminarily ejected ink receiver may include a heat generating unit for evaporating a liquid component of ink preliminarily ejected from the recording head and deposited on the heat generating unit.

According to the inkjet recording apparatus of the present invention arranged as described above, a liquid component of ink preliminarily ejected from the recording head and deposited on the heat generating unit is evaporated in a very short time, and a solid component of the ink is firmly fixed on a surface of the heat generating unit. Since the preliminarily ejected ink can be rapidly dried as described above, the ink can be prevented from dropping downward from the preliminary ejection receiver later. Since the ink does not drop downward from the preliminary ejection receiver, it is not necessary to provide a waste ink absorption body or the like in the recording apparatus, which can simplify an arrangement of the recording apparatus and reduce its size.

It is preferable to provide a cleaner for removing the solid component of the ink firmly fixed on the surface of the heat generating unit after the liquid component of the ink deposited on the heat generating unit has been evaporated.

The inkjet recording apparatus may include a carriage on which the recording head is mounted and which is scanned with respect to the medium to be recorded. A preliminarily ejected ink receiver may be disposed at a position which is located outside a region where an image can be recorded on the medium to be recorded and which faces the ink ejecting port surface of the recording head having been moved outside the region by the carriage.

The inkjet recording apparatus of the present invention may include a carriage on which a recording head is mounted and a heat generating member. The recording head records an image on a lower surface of a medium by ejecting ink from ejecting ports upward against gravity. The carriage is scanned with respect to the medium to be recorded, and the heat generating member extends over a scanning range of the carriage along a scanning direction thereof, is disposed at a position facing the ink ejecting port surface of the recording head and evaporates a liquid component of ink preliminarily ejected from the recording head and deposited on the heat generating member.

According to the inkjet recording apparatus of the present invention, a region of the heat generating member for receiving the preliminarily ejected ink extends over a moving region of the carriage, and ink can be preliminarily ejected to the heat generating member while scanning the recording head mounted on the carriage. As a result, even if ink is continuously ejected, a liquid component of the ink can be sequentially and instantly evaporated on a surface of the heat generating member, which causes no insufficient evaporation of the ink. Further, since the heat generating member receives the preliminarily ejected ink in a wide region, a solid component of the ink dispersingly deposits on the surface of the heat generating member in a lengthwise direction, which can reduce the number of times the heat generating member must be cleaned.

Generation of heat from the heat generating member not only in a preliminarily ejecting operation but also in an image recording operation permits a medium to be heated from a back surface of a recording surface thereof in the image recording operation. With this operation, water of ink deposited on the recording surface can be rapidly dried, whereby a fixing time of ink to the medium can be reduced.

A cleaner for removing the solid component of the ink firmly fixed on the surface of the heat generating member after the liquid component of the ink deposited on the heat generating member has been evaporated may be mounted on the carriage in place of the recording head. With this arrangement, the solid component of the ink firmly fixed on the heat generating member can be removed by the cleaner by reciprocating the carriage in a scanning direction.

Further objects, features and advantages of the present invention will become apparent from the following description of the preferred embodiments with reference to the attached drawings.

DESCRIPTION OF THE PREFERRED EMBODIMENTS

Next, an embodiment of the present invention will be described with reference to the drawings.

FIRST EXAMPLE

Figure 2:
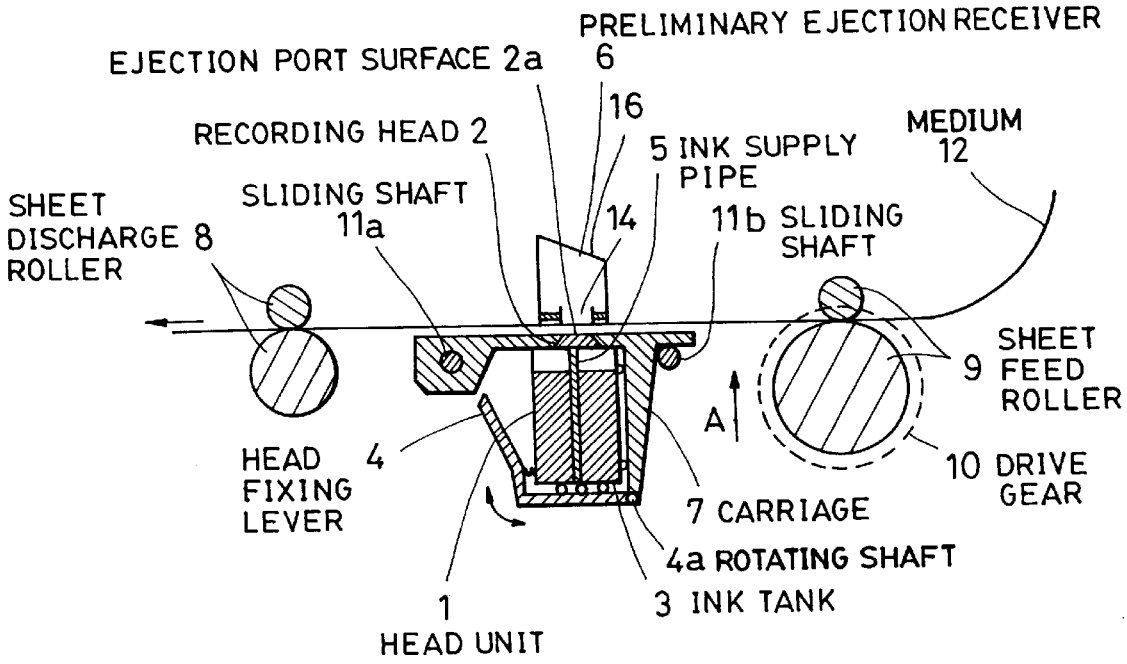
FIG. 2 is a view showing a main arrangement of a first example of an inkjet recording apparatus of the present invention.

FIG. 2 is a view showing a main arrangement of a first example of an inkjet recording apparatus of the present invention arranged so as to eject ink upward.

As shown in FIG. 2, in the inkjet recording apparatus of the present invention, a carriage 7, on which a head unit 1 is mounted, is disposed below a transportation path, which is composed of sheet feed rollers 9 and sheet discharge rollers 8 (which will be described later), for a medium 12, wherein the head unit 1 is composed of a recording head 2 and an ink tank 3 for accommodating ink to be supplied to the recording head 2. The head unit 1 is mounted on the carriage 7 with an ink ejecting port surface 2*a* facing upward so as to form an image on a medium 12 by ejecting ink onto a lower surface of the medium 12.

The carriage 7 is supported by two sliding shafts 11*a* and 11*b* and reciprocated by a carriage drive motor (not shown) through a timing belt (not shown) in a direction (vertical to the figure) normal to a direction in which the medium 12 is transported (right to left direction on the figure). A head fixing lever 4, which is rotatable about a rotating shaft 4*a*, is disposed with respect to the carriage 7 so that the head unit 1 can be mounted on the carriage 7 accurately by fixing it to the carriage 7 while rotating it.

Note that these two sliding shafts 11*a* and 11*b* support the carriage 7 and determine a scanning direction thereof as well as regulate a distance between the ink ejecting port surface 2*a* of the recording head 2 and the medium 12 facing the surface 2*a* to permit an image of high accuracy to be formed on the medium 12.

As the carriage 7 moves, the inkjet recording apparatus creates an image for each scan on a lower surface of the medium 12 by ejecting ink from the recording head 2 during movement of the recording head 2 while alternately repeating reciprocating movement of the recording head 2 and transportation of the medium 12 at a predetermined pitch.

A pair of the sheet feed rollers 9, which constitute a transportation unit for transporting the medium 12, are disposed upstream of the carriage 7 with respect to a transporting direction of the medium 12. The medium 12 is supplied to the sheet feed rollers 9 from an auto sheet feeder (not shown) or a cassette (not shown) mounted on the recording apparatus. The sheet feed rollers 9 are driven by a drive unit (not shown) through a drive gear 10.

A guide member (not shown) is disposed downstream of the sheet feed rollers 9 with respect to the transporting direction of the medium 12. The guide member prevents the ink ejecting port surface 2*a* from coming into contact with the medium 12 by preventing floating and twisting of the medium 12 at a position where it faces the ink ejecting port surface 2*a* as well as keeps a distance between the ink ejecting port surface 2*a* and the lower surface of the medium 12 constant, thereby maintaining a position where ink reaches the medium 12 at a high degree of precision.

A pair of the sheet discharge rollers 8 are disposed downstream of the carriage 7 with respect to the transporting direction of the medium 12. After the medium 12 reaches the sheet discharge rollers 8, it is transported further, mainly by the sheet discharge rollers 8, and the medium 12, on which an image is created by the recording head 2, is discharged to the outside of the recording apparatus.

Figure 3:
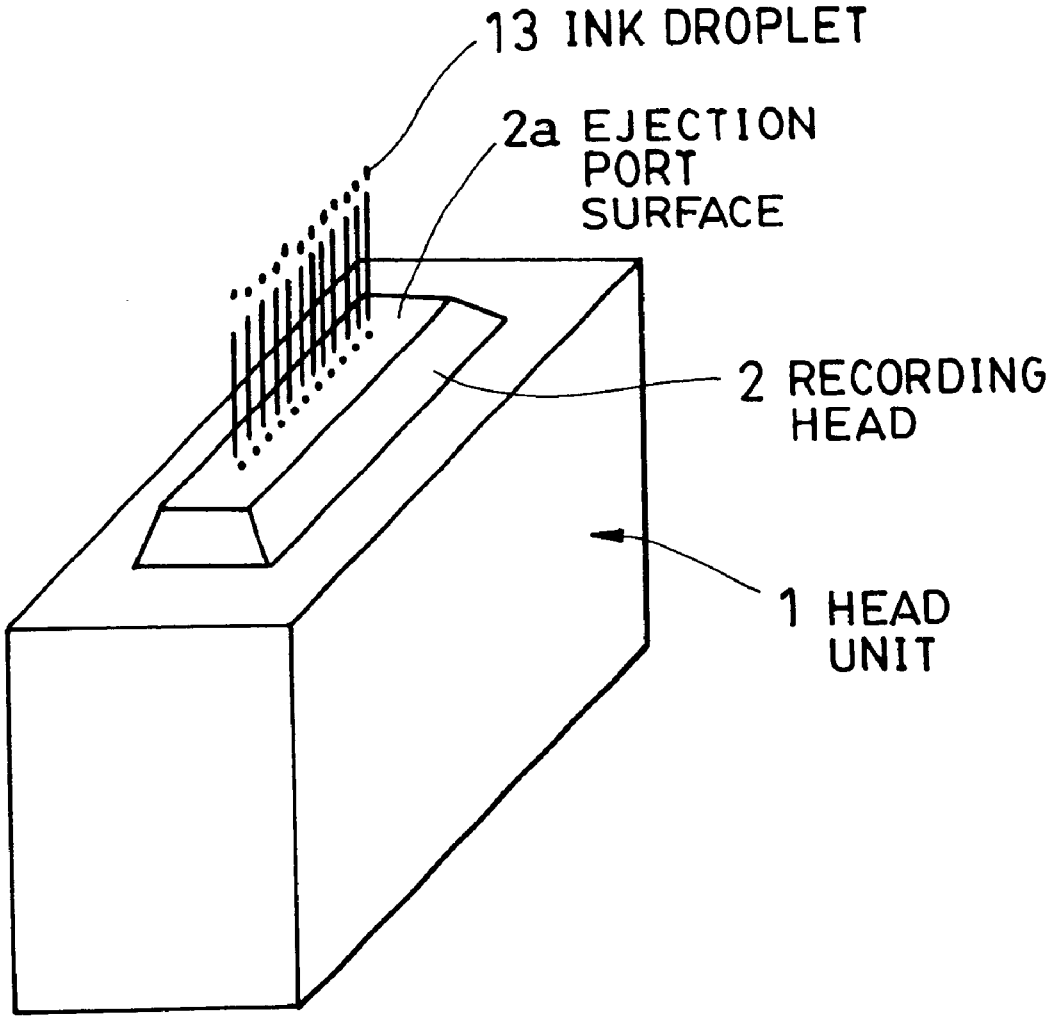
FIG. 3 is a perspective view showing a head unit shown in FIG. 2.

FIG. 3 is a perspective view showing the head unit 1 shown in FIG. 2. As shown in FIG. 3, the head unit 1 includes a plurality of ink ejecting ports disposed on the ink ejecting port surface 2*a* to eject ink and forms the image on the lower surface of the medium 12 by ejecting ink droplets 13 upward from the ink ejecting port surface 2*a,* that is, in a direction shown by an arrow A of FIG. 2. Note that, as shown in FIG. 2, an ink supply pipe 5 is disposed under the recording head 2 to supply ink in the ink tank 3 to nozzles. The ink supply pipe 5, which is composed of a thin tube, takes up ink making use of a capillary force, and supplies it to the ink ejecting port surface 2*a.* A meniscus surface of ink is formed in the vicinity of an ejecting port of each nozzle by a negative pressure which is produced by gravity and balanced with surface tension.

The inkjet recording apparatus of this example includes a preliminary ejection receiver 6 for receiving ink ejected from the recording head 2. The preliminary ejection receiver 6 is provided with an opening 14 (refer to FIG. 4), which acts as an inlet of ink preliminarily ejected from the recording head 2, facing downward.

Figure 4:
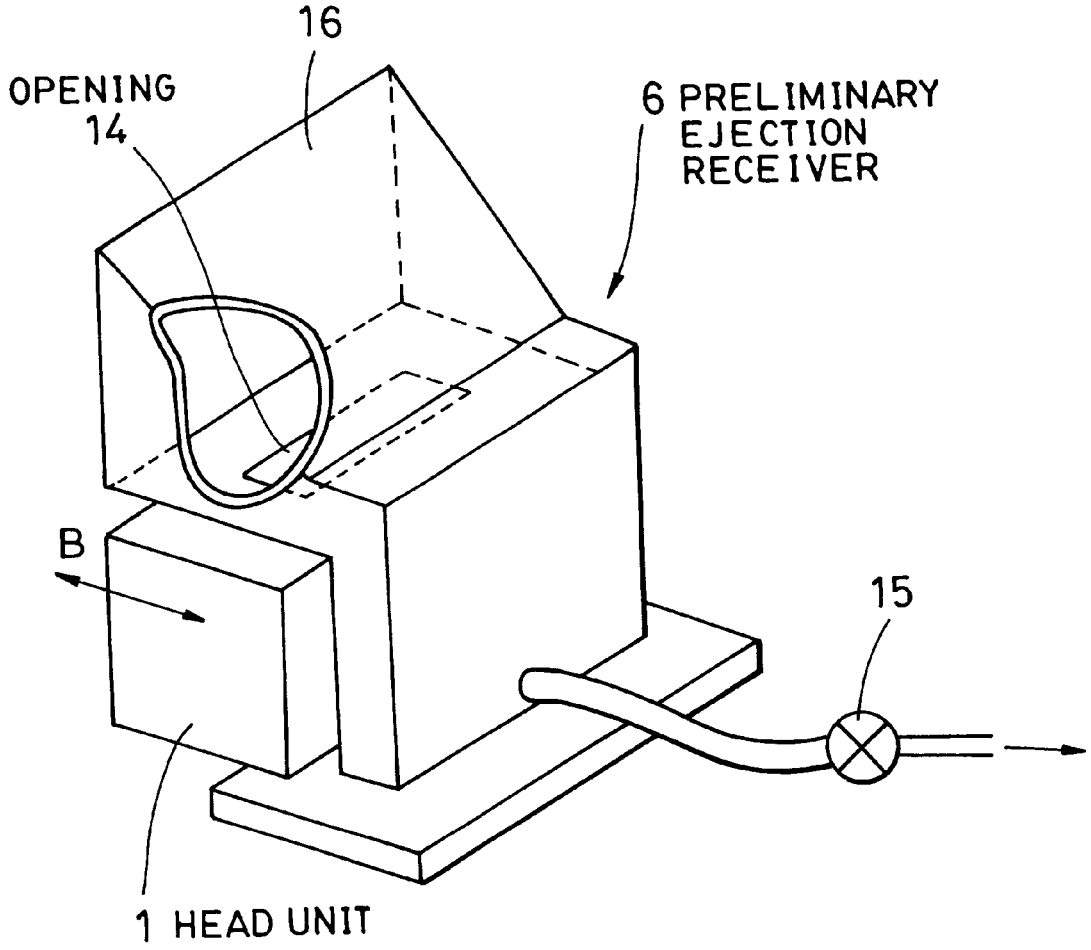
FIG. 4 is a perspective view showing a preliminary ejection receiver shown in FIG. 2 and the head unit moved below the preliminary ejection receiver.

FIG. 4 is a perspective view showing the preliminary ejection receiver shown in FIG. 2 and the head unit 1 moved below the preliminary ejection receiver. Note that FIG. 4 shows the preliminary ejection receiver 6 in a partial cutaway view to illustrate the opening 14 thereof.

In the recording apparatus, the preliminary ejection receiver 6 is disposed outside a region where recording can be executed to the medium 12 by the recording head 2. More specifically, the preliminary ejection receiver 6 is disposed at a position in the vicinity of a terminal end in a moving direction B of the carriage 7 (refer to FIG. 2) which moves along the sliding shafts 11*a* and 11*b,* so that the ink ejecting port surface 2*a* of the head unit 1 mounted on the carriage 7 faces the opening 14 of the preliminary ejection receiver 6 when the carriage 103 moves to the terminal end.

Figure 5:
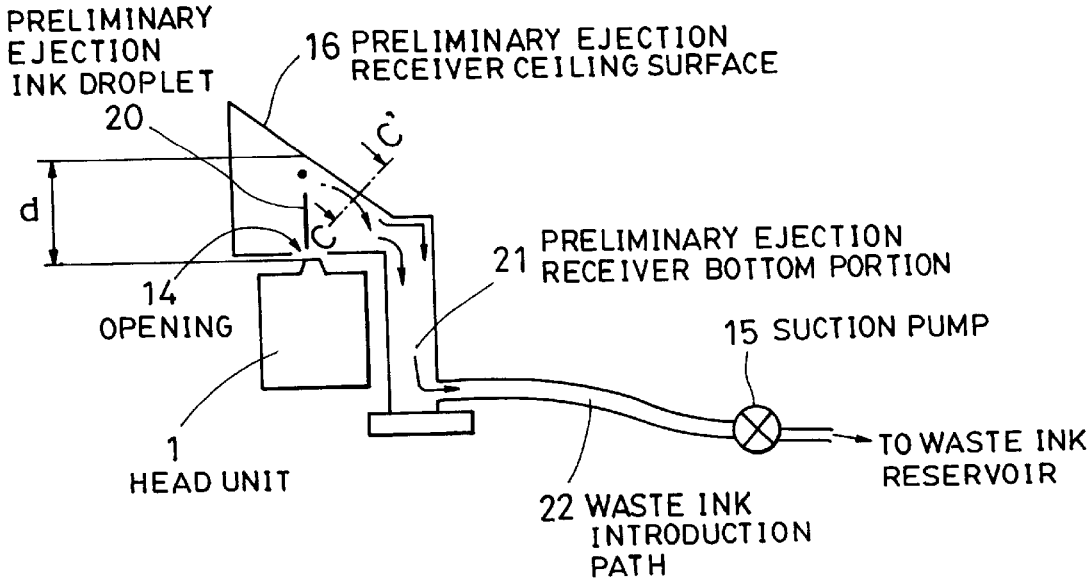
FIG. 5 is a sectional view showing the preliminary ejection receiver and the head unit shown in FIG. 4.

FIG. 5 is a sectional view showing the preliminary ejection receiver 6 and the head unit 1 shown in FIG. 4.

The preliminary ejection receiver 6 in this example has a preliminary ejection receiver ceiling surface 16 disposed above a surface where the opening 14 is formed. The preliminary ejection receiver ceiling surface 16 receives ink droplets 20 preliminarily ejected from the head unit 1. The preliminary ejection receiver ceiling surface 16 inclines with respect to a horizontal direction.

The ink droplets 20, which are preliminarily ejected into the preliminary ejection receiver 6 from the head unit 1 through the opening 14, deposit on the preliminary ejection receiver ceiling surface 16. The ink deposited on the ceiling surface 16 flows downward along the inclining ceiling surface 16 due to gravity and is collected in a preliminary ejection receiver bottom 21 which is connected to a lower portion of the preliminary ejection receiver 6 and acts as an ink discharge unit for discharging ink to the outside of the preliminary ejection receiver 6. The ink collected in the preliminary ejection receiver bottom 21 is sucked by a suction pump 15 through a waste ink introduction path 22 connected to preliminary ejection receiver bottom 21 and discharged into a waste ink reservoir (not shown).

As described above, the inclining preliminary ejection receiver ceiling surface 16 acts as an ink leakage prevention unit for preventing ink from leaking to the outside of the preliminary ejection receiver 6 through the opening 14, and the preliminarily ejected ink is discharged to the outside of the preliminary ejection receiver 6 without flowing to the opening 14. Accordingly, it can be prevented that the preliminarily ejected ink leaks from the opening 14 and pollutes the head unit 1 and an interior of the recording apparatus.

Note that while the waste ink in the preliminary ejection receiver bottom 21 is forcibly discharged using the suction pump 15 in the example, it may be discharged naturally by only gravity without using the suction pump 15. Furthermore, when it is possible to provide a sufficient volume of the preliminary ejection receiver bottom 21, the waste ink introduction path 22 is not necessarily required and the preliminary ejection receiver bottom 21 may be directly connected to the waste ink reservoir.

Figure 6:
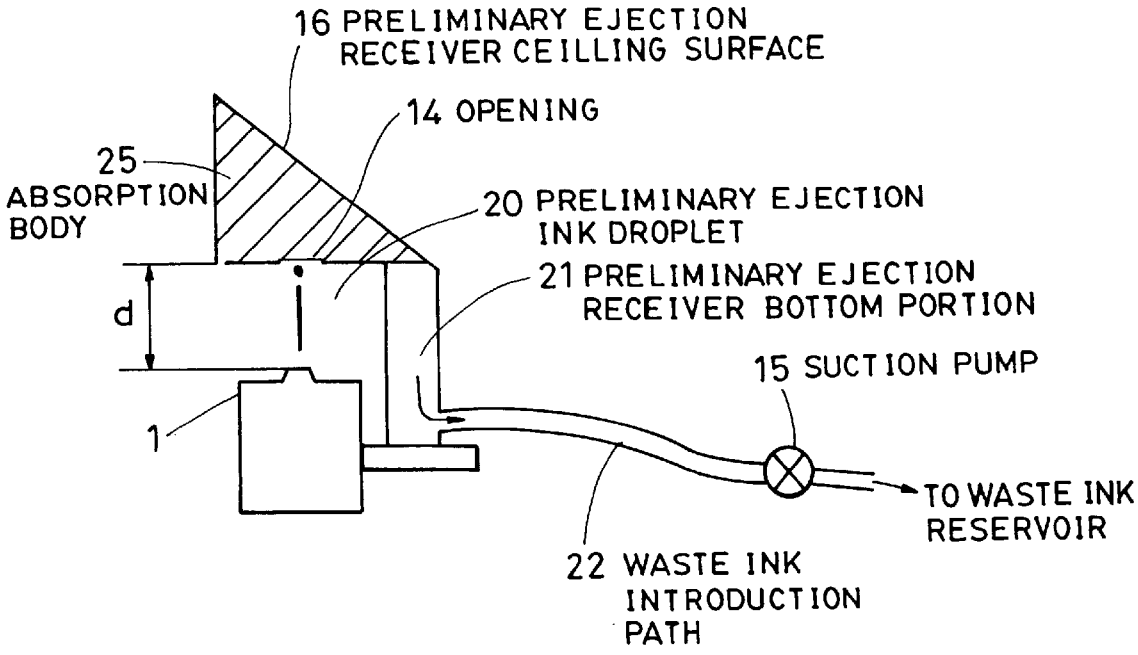
FIG. 6 is a sectional view showing another example of the preliminary ejection receiver.

The velocity of ejected ink decreases to zero when a predetermined time passes after it is ejected. It is important to receive the ejected ink on the ceiling surface 16 of the preliminary ejection receiver before the velocity of the ejected ink drops to zero. The distance "d" shown in FIG. 5, represents a distance between the ejecting port 2*a* and the ceiling surface 16 of the preliminary ejection receiver 6, which faces the ejecting port 2*a*. Otherwise, when an absorption body 25 is disposed in the preliminary ejection receiver 6, as shown in FIG. 6, and ink received by the absorption body 25 is sucked by the suction pump 15 for collection, the distance "d" represents a distance from the ejecting port 2*a* to a surface of the absorption body 25 disposed facing the opening 14 of the preliminary ejection receiver 6.

As a particle having an initial velocity flies against a viscosity resistance, a flying velocity of the particle becomes zero as time passes, and the particle floats. The particle finally drops under the influence of gravity. However, in a fine particle such as an ink droplet used in an inkjet, gravity can be ignored within at least a time range during which ink is received because the viscosity resistance greatly acts on the ink droplet as compared with gravity. This status can be understood by solving the following fundamental differential equation:

$$m\frac{dv}{dt} + av = 0$$

where m and v represent a mass (an amount of ejection of an ink droplet) and a velocity of the particle, and α represents a viscosity resistance applied to the particle. The viscosity resistance is a coefficient proportional to the velocity and can be shown as follows:

$$a=6\pi\eta D$$

where η represents an environmental viscosity resistance which is ordinarily a viscosity resistance of air, and D represents a radius of the particle. The differential equation can be solved as follows:

$$v = v_o e^{-\frac{a}{m}t}$$

When a position x is determined by solving the above equation, the following equation is obtained:

$$x = \frac{mv_o}{a}\left(1 - e^{-\frac{a}{m}t}\right)$$

Since the characteristic of the above equation becomes zero when time passes, the following equation can be obtained:

$$x = \frac{mv_o}{a}$$

This means that the particle rests at a predetermined position.

The following equation can be obtained by further rewriting the above equation:

$$x = \frac{mv_o}{6\pi\eta D}$$

A density of the ink particle is represented by ρ, and thus the following equation is obtained:

$$m = \rho\frac{4}{3}\pi D^3$$

Accordingly, the following equation can be obtained:

$$x = \frac{mv_o}{6\pi\eta\sqrt[3]{\frac{3m}{4\pi\rho}}}$$

Figure 18:
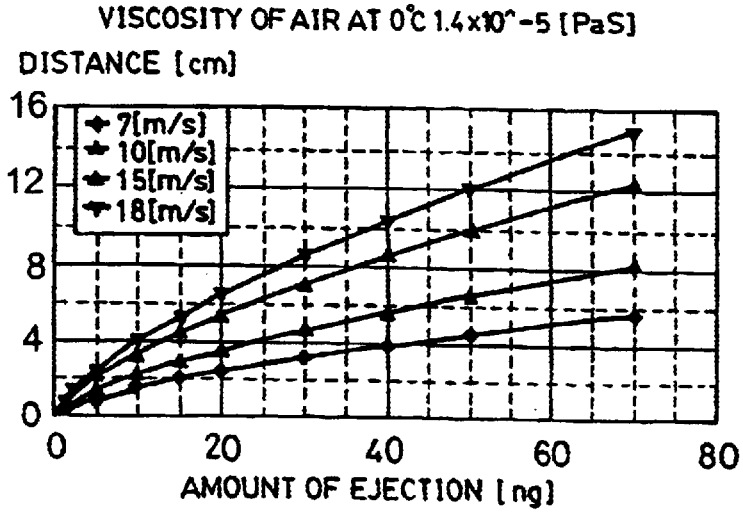
FIG. 18 is a graph showing an arrival distance of ink when a viscosity resistance of air at 0° C. and an amount of ejection of ink are used as parameters and an initial ejection speed is set to 7, 10, 15, and 18 m/s.
Figure 19:
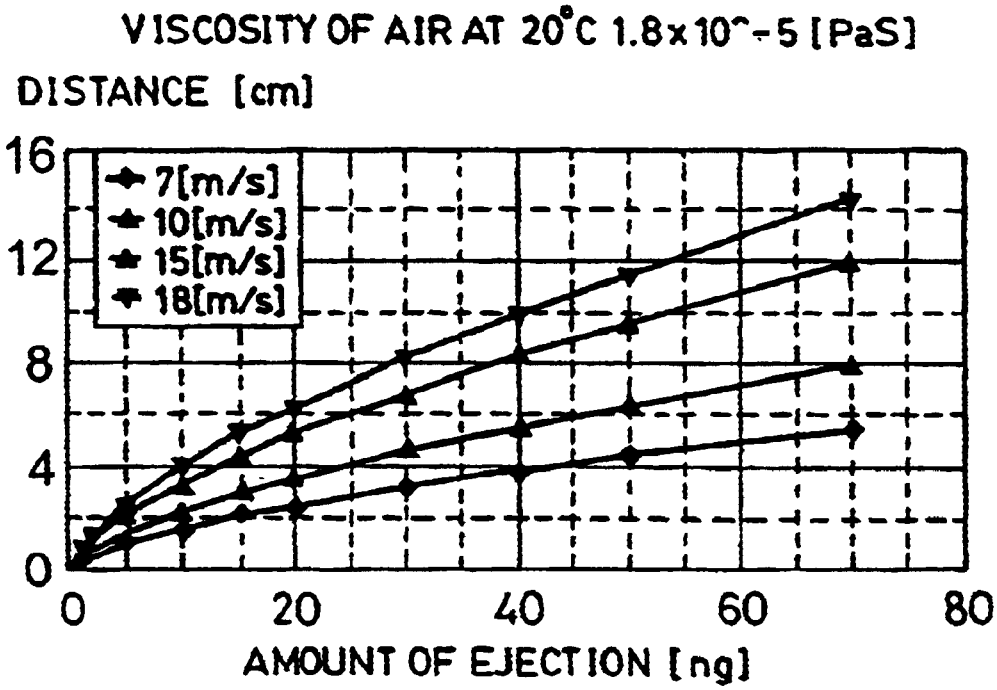
FIG. 19 is a graph showing an arrival distance of ink when a viscosity resistance of air at 20° C. and an amount of ejection of ink are used as parameters and an initial ejection speed is set to 7, 10, 15, and 18 m/s.
Figure 20:
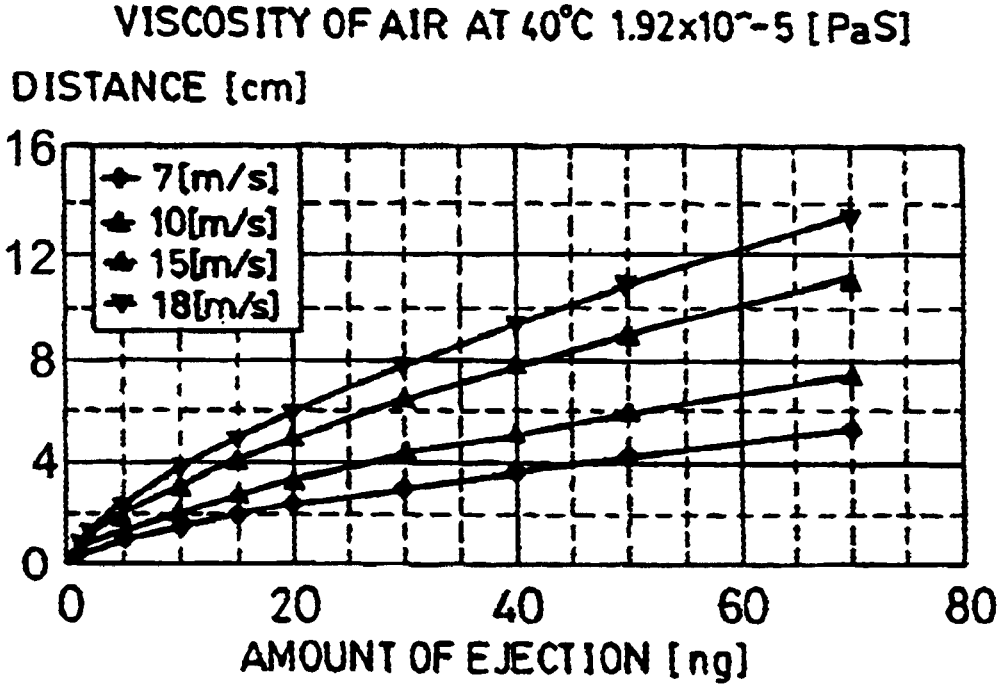
FIG. 20 is a graph showing an arrival distance of ink when a viscosity resistance of air at 40° C. and an amount of ejection of ink are used as parameters and an initial ejection speed is set to 7, 10, 15, and 18 m/s.

This equation provides an arriving distance of the particle. It is necessary to provide a surface for receiving the ink particle at a position whose distance from the ejecting port is less than this value, in order to have the ink particle received by the preliminary ejection receiver 6. FIGS. 18 to 20 show arriving distances by assuming $\rho=1\times10^3$ kg/m$^3$, using viscosity resistances of air and amounts of ejection at respective temperatures of 0° C., 20° C., and 40° C. as parameters, and further setting initial ejection speeds to 7, 10, 15, and 18 m/s.

Accordingly, it is one of the important requirements of the present invention that the distance d from the ejecting port to the ceiling surface 16 for receiving the ink satisfies the following formula:

$$d < \frac{mv_o}{6\pi\eta\sqrt[3]{\frac{3m}{4\pi\rho}}}$$

While upward ejection is within an applicable range of the present invention, it must be added that the distance does not necessarily mean a vertically upward distance, but means a distance along the ejecting velocity. In particular, when an ink droplet appears in a state in which it is divided into a main droplet and a satellite, this value must be set in accordance with a droplet having a small initial speed and a small diameter (small mass). When a delicate tradeoff exists, the value must be set in accordance with a particle having a smallest arrival distance among the particles which must be received by the preliminary ejection receiver. In particular, since the viscosity of a gas increases as the temperature increases, it is necessary to take the viscosity of the gas at an assumed upper limit internal temperature of a printer into consideration.

The recording head 2 used in this example may be any recording head as long as it ejects ink upward from ejecting ports against gravity, and the recording head can optionally select any ink ejecting method. Thus, the ink ejecting method may be a bubble jet system for causing film boiling in ink using, for example, an electrothermal transducer such as a heater or the like and ejecting the ink by a pressure impact of the film boiling or a piezo-type inkjet system for contracting a volume of an interior of a nozzle at a predetermined position using an electrodynamic transducer such as a piezo element and ejecting ink by a change of volume or pressure in the nozzle.

Further, the above description has been made using the serial type inkjet recording apparatus as an example which employs a serial scan system for causing the recording head 2 to execute scan in a direction normal to a direction in which the medium 12 is transported (auxiliary scanning direction). However, the inkjet recording apparatus of this example is not limited to the serial type and may be a line type inkjet recording apparatus for recording an image on the overall medium 12 by repeating an operation for recording data for one line on the medium 12 as a single unit, and then recording data for another line thereon as a single unit after feeding the medium 12 by a predetermined amount (pitch feed).

Next, various other examples of the above-mentioned preliminary ejection receiver will be explained with reference to the drawings.

SECOND EXAMPLE

Figure 7:
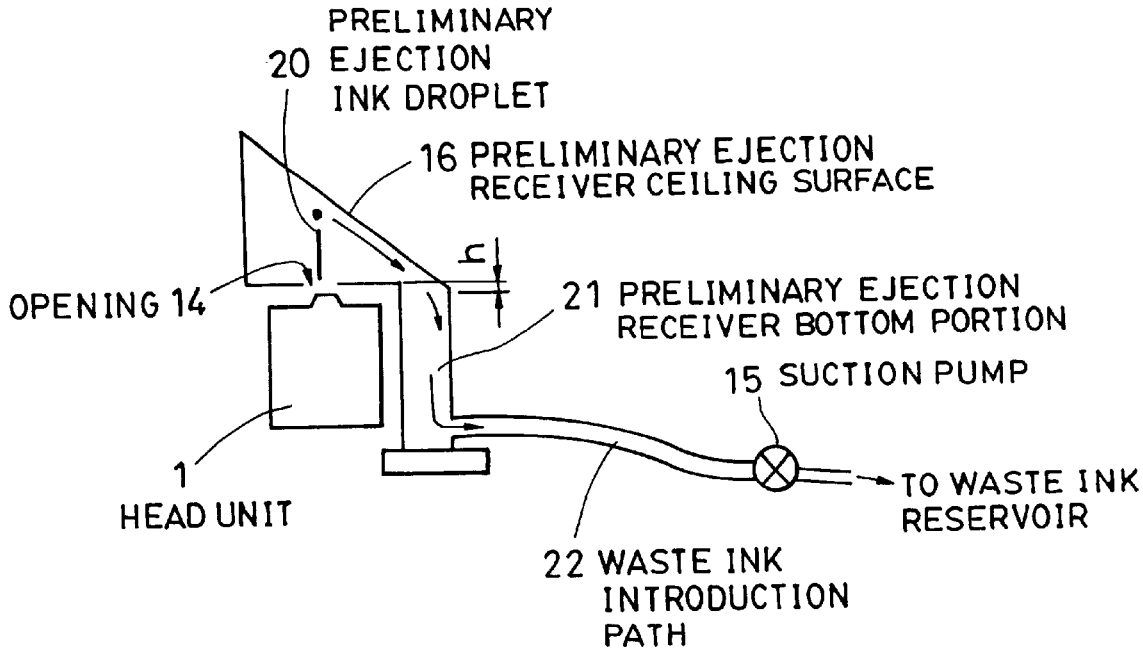
FIG. 7 is a sectional view showing a second example of the preliminary ejection receiver and the head unit.

FIG. 7 is a sectional view showing a second example of the preliminary ejection receiver shown in FIG. 4 and the head unit 1 disposed below it. In this example, a preliminary ejection receiver ceiling surface 16 is formed longer than that of the example shown in FIG. 6, and a lower end of the ceiling surface 16 is located at a position which is lower than a surface where an opening 14 of a preliminary ejection receiver 6 is formed by a height h.

With this arrangement, ink can be prevented from dropping onto the surface where the opening 14 of the preliminary ejection receiver 6 is formed from the lower end of the ceiling surface 16, which more reliably prevents the ink droplets 20 from reaching the opening 14.

THIRD EXAMPLE

Figure 8:
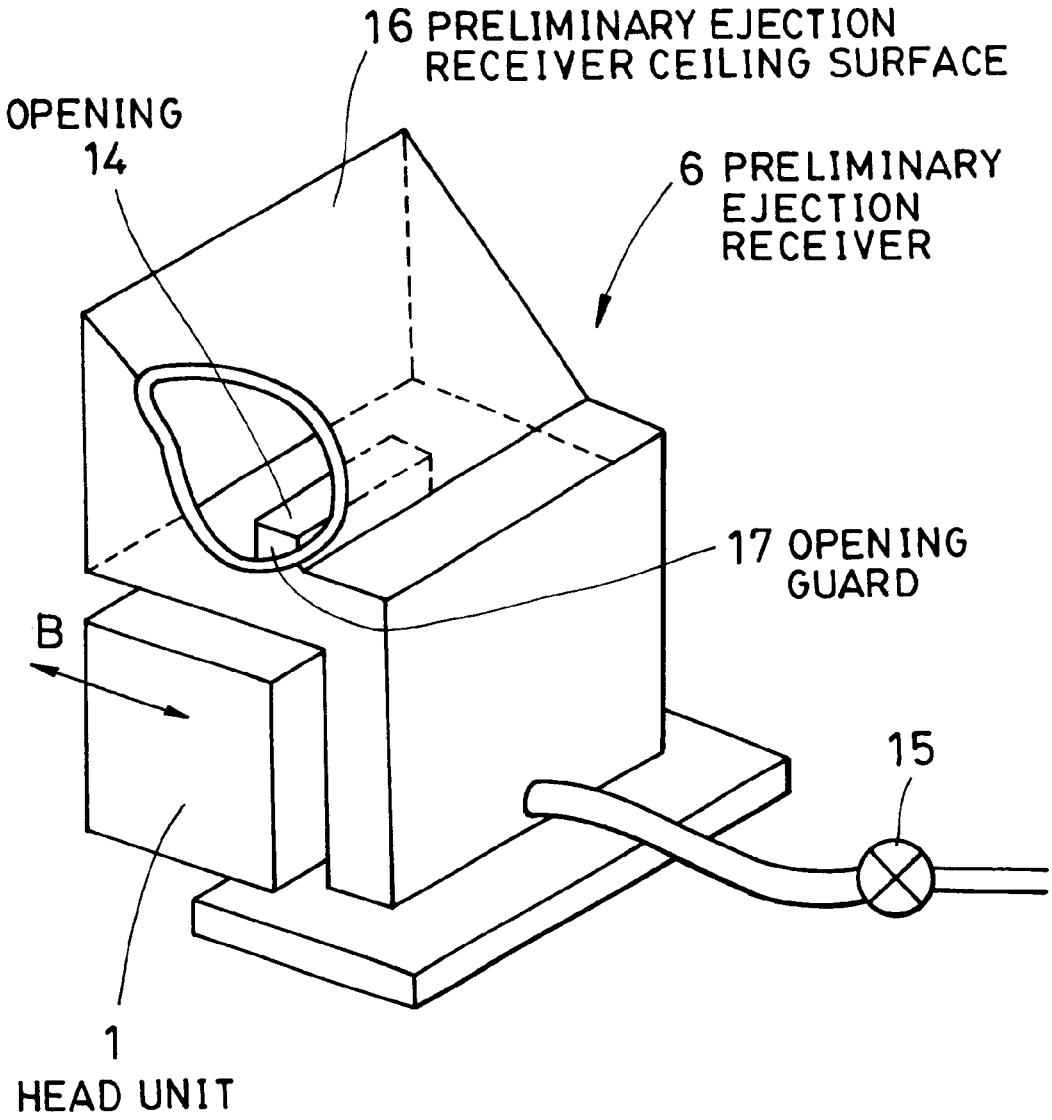
FIG. 8 is a perspective view showing a third example of the preliminary ejection receiver and the head unit.
Figure 9:
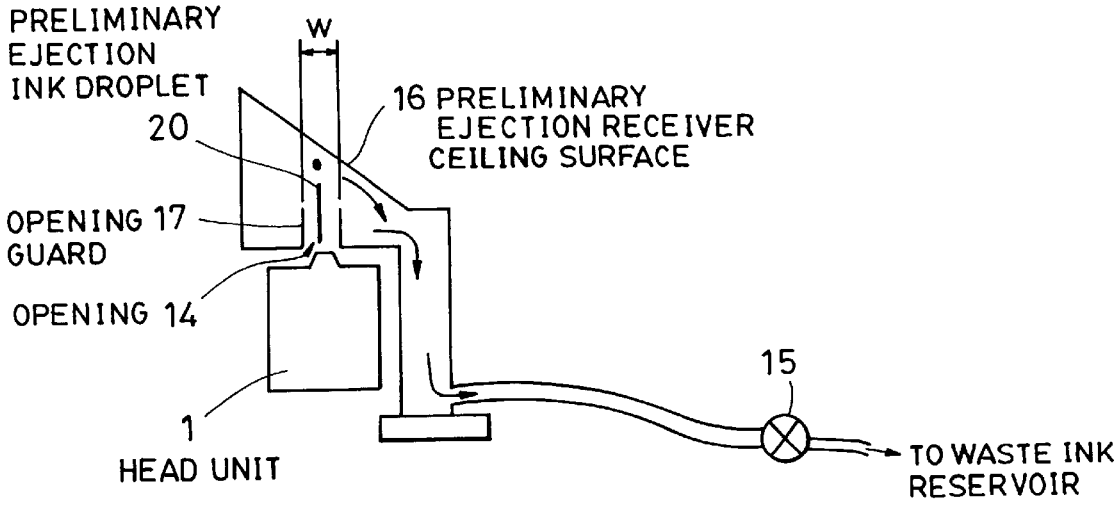
FIG. 9 is a sectional view of the preliminary ejection receiver shown in FIG. 8.

FIG. 8 is a perspective view showing a third example of the preliminary ejection receiver shown in FIG. 4 and the head unit 1 disposed below it, and FIG. 9 is a sectional view showing the preliminary ejection receiver and the head unit shown in FIG. 8.

In this example, an opening guard 17, which is formed as a projection, is disposed around the opening 14 of the preliminary ejection receiver 6 and projects toward a hollow portion of the preliminary ejection receiver 6. With this arrangement, even if preliminarily ejected ink droplets 20 drop to a periphery of the opening 14 from a ceiling surface 16, the ink droplets 20 are dammed around the periphery of the opening 14 by the guard 17. Thus, there is no possibility that the ink will leak to the outside of the preliminary ejection receiver 6 by passing through the opening 14. While it is preferable that the opening 14 have a width as narrow as possible, the width w is appropriately set in consideration of a distance from the opening 14 to the ceiling surface 16, an inclining angle of the ceiling surface 16, a height of the opening guard 17, an ejecting velocity of ink, and the like. Note that the size and form of the opening guard 17 are a matter of design.

FOURTH EXAMPLE

Figure 10:
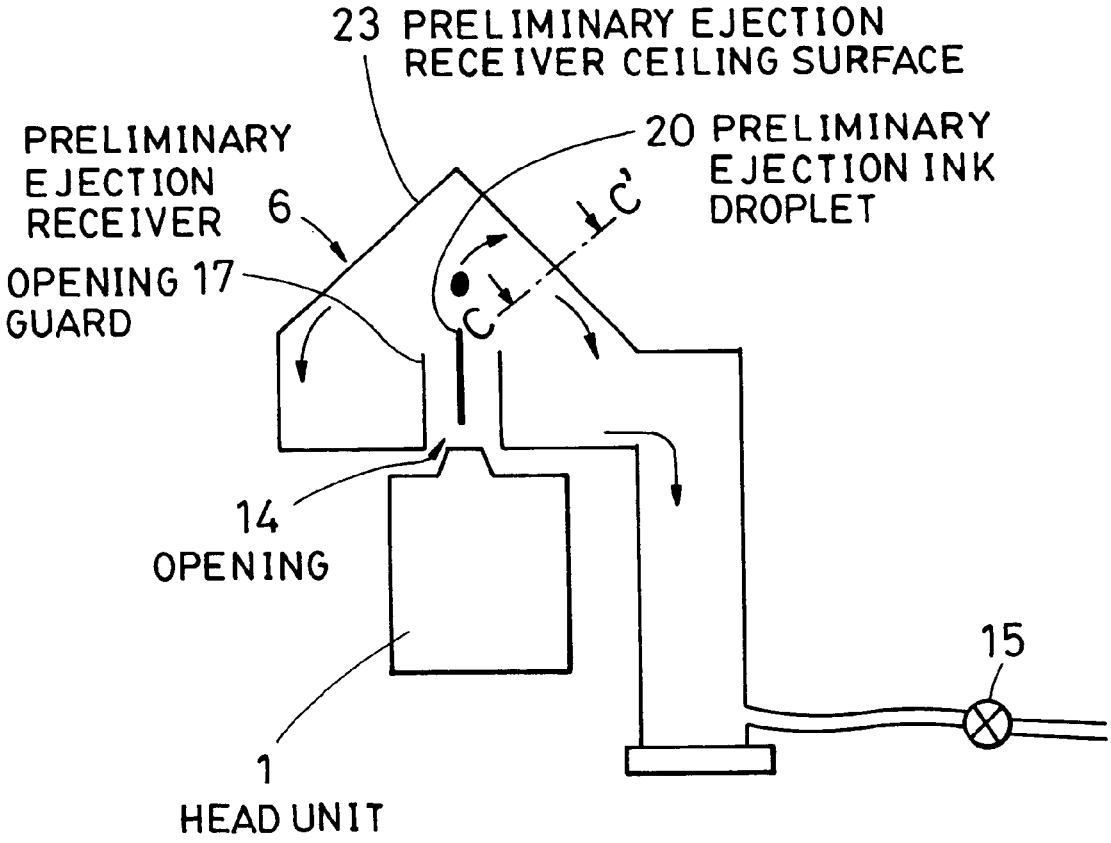
FIG. 10 is a sectional view showing a fourth example of the preliminary ejection receiver and the head unit.

FIG. 10 is a sectional view showing a fourth example of the preliminary ejection receiver shown in FIG. 4 and the head unit 1 disposed below the preliminary ejection receiver 6. A preliminary ejection receiver ceiling surface 23 of the modification is formed in a triangular roof shape having an inclining portion divided into two parts at a central portion above an opening 14.

Since preliminarily ejected ink droplets 20 fly for a time longer than that when an image is formed on a medium, the ink droplets 20 are ejected in dispersed directions. As a result, if the ceiling surface is arranged as shown in, for example FIG. 5, ink droplets ejected in a left direction in the figure do not deposit on the ceiling surface 16 and may drop toward the opening 14 by, for example, bounding back on a left surface of the preliminary ejection receiver 6.

In contrast, according to the fourth example, since the inclining portion of the ceiling surface 23 is divided into the two parts at the central portion above the opening 14 and both the inclining portions incline downward, the ink droplets 20 can satisfactorily deposit on the ceiling surface 23 even if they are ejected in dispersed directions.

As a result, according to the modification, it can be avoided that ink directly drops toward the opening 14. Furthermore, since the ceiling surface 23 has an increased area on which ink can deposit, an amount of ink held on the ceiling surface 23 is increased, which can more reliably prevent leakage of ink from the opening 14.

Note that it is preferable in this example to provide an opening guard 17 as described above around a periphery of the opening 14.

FIFTH EXAMPLE

Figure 11:
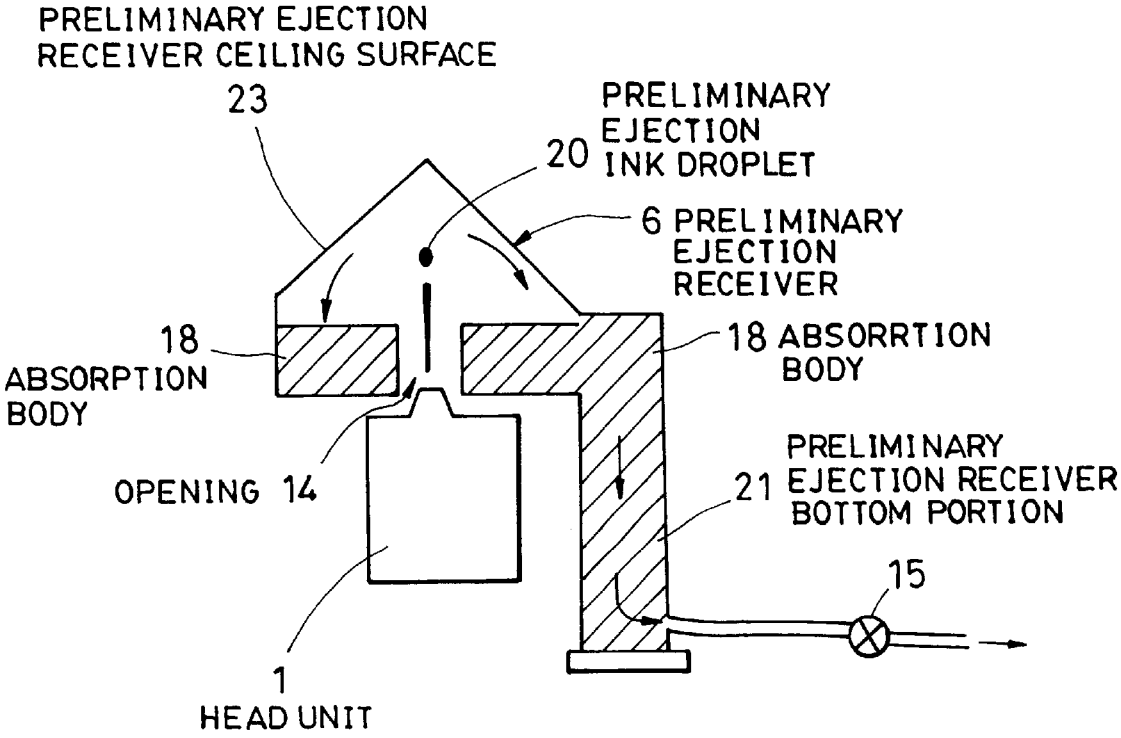
FIG. 11 is a sectional view showing a fifth example of the preliminary ejection receiver and the head unit.

FIG. 11 is a sectional view showing a fifth example of the preliminary ejection receiver shown in FIG. 4 and the head unit 1 disposed below the preliminary ejection receiver 6. A preliminary ejection receiver ceiling surface 23 of the modification also is formed in a triangular roof shape having an inclining portion divided into two parts at a central portion above the opening 14, similarly to that shown in FIG. 10. In this modification, a porous absorption body 18 composed of a material such as polyurethane or the like is disposed on a surface, where the opening 14 of a preliminary ejection receiver 6 is formed, and in a preliminary ejection receiver bottom 21. However, no absorption body 18 is disposed on a region of the surface where the opening 14 of the preliminary ejection receiver 6 is formed.

Further, in this modification, an opening guard (refer to FIG. 10) is not disposed around a periphery of the opening 14.

The absorption body 18 can absorb ink in the interior thereof by generating a negative pressure by a capillary force. As a result, the absorption body 18 can effectively prevents leakage of ink from the opening 14. Note that the negative pressure generated in the absorption body 18 need not be extremely large, and it is sufficient for the negative pressure to have a magnitude capable of preventing the leakage of the ink from the opening 14.

Figure 12:
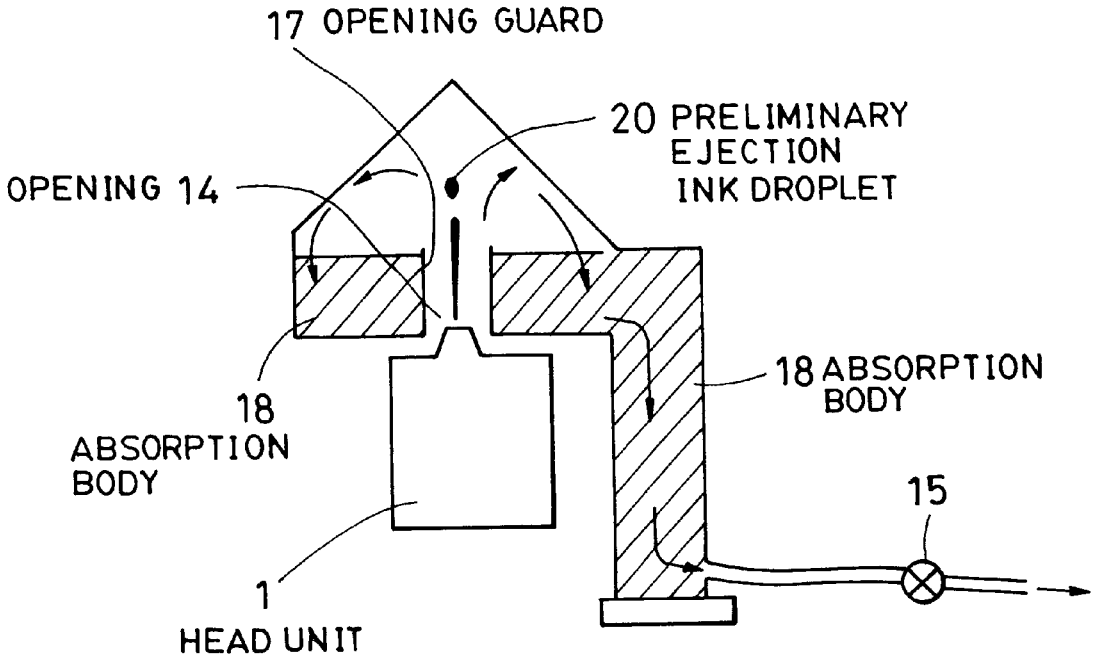
FIG. 12 is a sectional view showing another example of the preliminary ejection receiver and the head unit.
Figure 13:
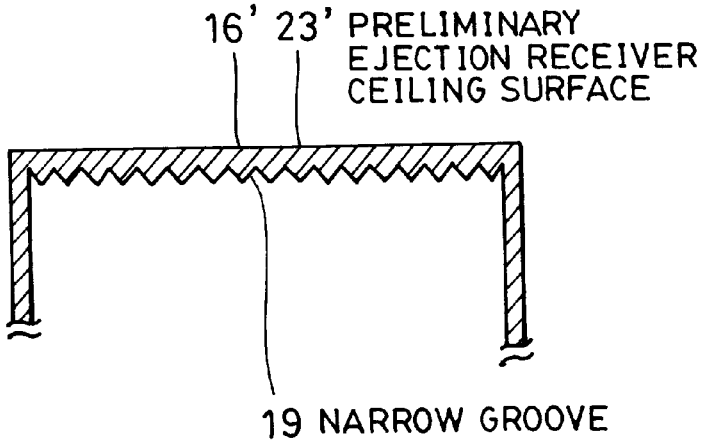
FIG. 13 is a sectional view of a ceiling surface of the preliminary ejection receivers shown in FIGS. 5 and 10 taken along a line C–C'.

Note that, as shown in FIG. 12, an opening guard 17 may be disposed around a periphery of the opening 14 as shown in FIG. 9 in order to more reliably prevent the leakage of the ink from the opening 14.

In the preliminary ejection receiver ceiling surfaces 16 and 23 in the above-mentioned examples, an ink receiving surface is formed flat. However, ink can be more satisfactorily collected by forming a plurality of thin grooves 9 across a cross section taken along a line C—C (of, for example, FIG. 5) of the preliminary ejection receiver ceiling surface along a direction in which the ceiling surface inclines (16' and 23').

These thin grooves 19 can flow ink as ink droplets 20 along the ceiling surface without dropping them downward after they capture the ink droplets 20 ejected from the head unit 1 because they generate a capillary force. Accordingly, the drop and leakage of the ink from the opening 14 can be more reliably prevented.

As described above, in the inkjet recording apparatus of the present invention, the preliminary ejection receiver, which receives ink preliminarily ejected from the recording head that ejects ink upward from the ejecting ports, includes the opening and the ink leakage prevention unit, the opening acting as an inlet of the preliminarily ejected ink, and the ink leakage prevention unit being disposed above the opening to prevent the ink preliminarily ejected into the preliminary ejection receiver from leaking to the outside of the receiver from the opening. Accordingly, the inkjet recording apparatus can prevent ink from leaking from the opening of the preliminary ejection receiver to the outside thereof, whereby preventing an ejecting port forming surface of the recording head and the interior of the recording apparatus from being polluted with ink.

SIXTH EXAMPLE

Figure 1:
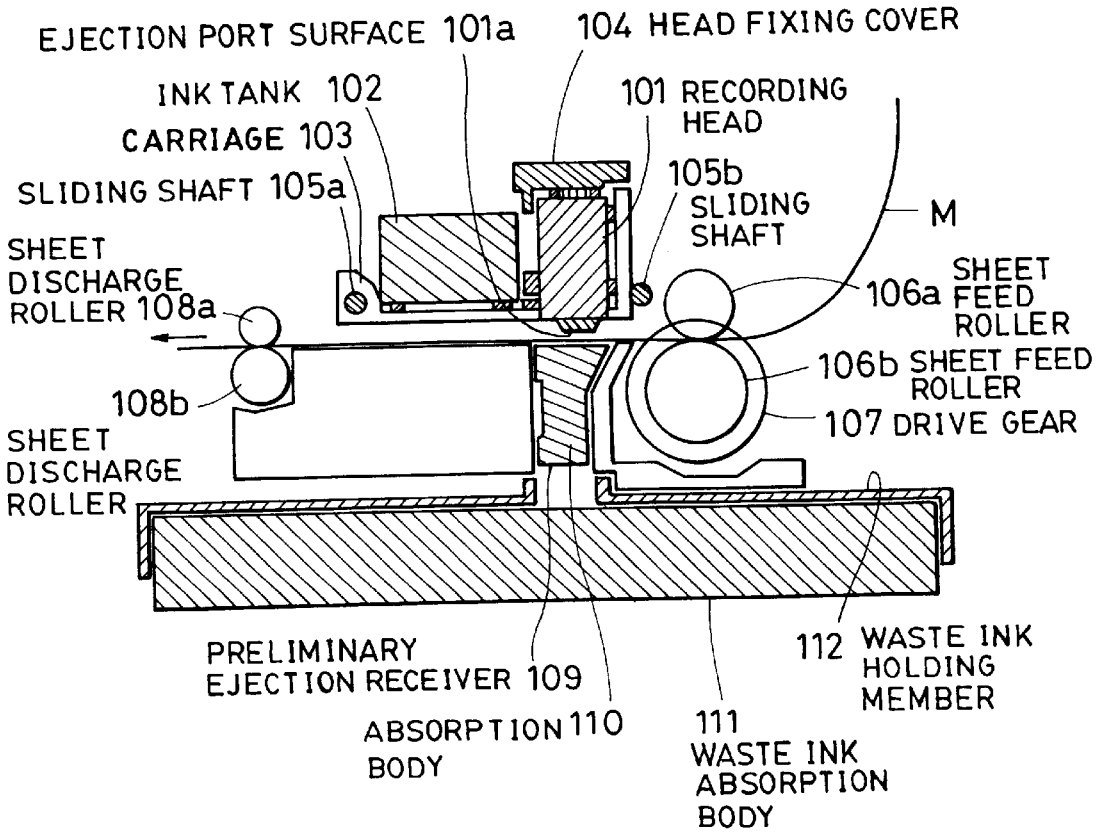
FIG. 1 is a sectional view showing a main portion of a conventional inkjet recording apparatus.
Figure 14:
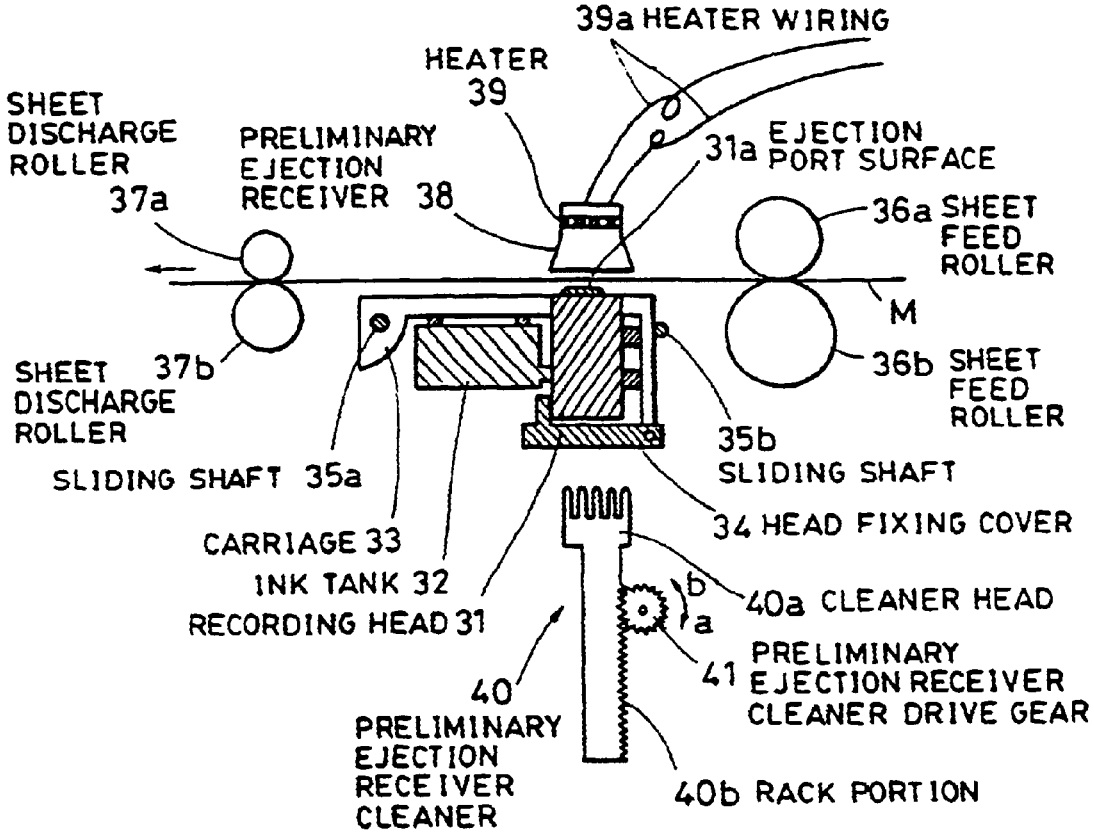
FIG. 14 is a sectional view showing a sixth example of the preliminary ejection receiver and the head unit.

FIG. 14 is a sectional view showing a main portion of a sixth example as another example of the inkjet recording apparatus of the present invention. Note that since a head fixing cover 34, sliding shafts 35*a* and 35*b*, sheet feed rollers 36*a* and 36*b* and sheet discharge rollers 37*a* and 37*b* of the inkjet recording apparatus of the example are arranged and operated similarly to those of the conventional inkjet recording apparatus described with reference to FIG. 1, detailed description thereof is omitted.

As shown in FIG. 14, in the inkjet recording apparatus of the example, a carriage 33, on which a recording head 31 is mounted, is disposed downward of a transportation path, which is composed of the sheet feed rollers 36*a* and 36*b* and the sheet discharge rollers 37*a* and 37*b*, for a medium M. The recording head 31 is mounted on the carriage 33 with an ink ejecting port surface 31*a* facing upward so as to form an image on the medium M by ejecting ink onto the lower surface thereof. An ink tank 32 for accommodating ink to be supplied to the recording head 31 also is mounted on the carriage 33.

Further, the inkjet recording apparatus of the example includes a preliminary ejection receiver 38 for receiving ink ejected from the recording head 31 with an opening facing downward which acts as an inlet of ink preliminarily ejected from the recording head 32. In the recording apparatus, the preliminary injection receiver 38 is disposed outside a region where recording can be executed on the medium M by the recording head 31. More specifically, the preliminary injection receiver 38 is disposed at a position in the vicinity of a terminal end in a moving direction of the carriage 33 which moves along the sliding shafts 35*a* and 35*b*. As a result, when the carriage 33 moves to the terminal end, the ink ejecting port surface 31*a* of the recording head 31 mounted on the carriage 33 faces the opening of the preliminary injection receiver 38.

Figure 15:
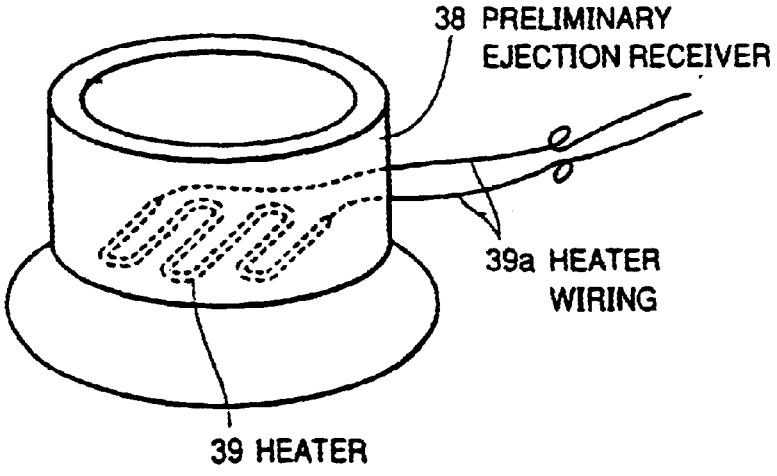
FIG. 15 is a perspective view of the preliminary ejection receiver shown in FIG. 14.

FIG. 15 is a perspective view of the preliminary ejection receiver shown in FIG. 14.

The preliminary ejection receiver 38 is formed with a uniform cross-sectional shape and size (and thus is, in technical mathematical terminology, a cylinder, although the shape of the cross-section can vary, and in the illustrated embodiment is square), and has an opening extending completely through it. Accordingly, the preliminary ejection receiver 38 is open to the atmosphere at the lower end and the upper end. A heater 39 bent in a wave-shape and acting as a heating unit is disposed in the preliminary ejection receiver 38. Heater wiring 39*a* is connected to both ends of the heater 39 to supply a current thereto, and the heater 39 generates heat by being energized through the heater wiring 39*a*.

Referring to FIG. 14 again, the inkjet recording apparatus of the example has a preliminary ejection receiver cleaner 40 for cleaning the heater 39 in the preliminary ejection receiver 38. The cleaner 40 is disposed below the preliminary ejection receiver 38 as well as below a moving region of the carriage 33 along the sliding shafts 35*a* and 35*b*. The cleaner 40 includes a cleaner head 40*a* for cleaning the heater 39 and a rack portion 40*b* formed so as to be meshed with a gear 41. The cleaner 40 can be moved in an up and down direction in FIG. 14 by rotating the gear 41 forward and backward.

Next, a preliminarily ejecting operation of the inkjet recording apparatus of the example will be described below.

When the recording head 31 preliminarily ejects ink in the inkjet recording apparatus of the example arranged as described above, the ink ejecting port surface 31*a* of the recording head 31 is caused to face the opening of the preliminary ejection receiver 38 by moving the carriage 33. Subsequently, the heater is caused to generate heat by supplying a current thereto from the heater wiring 39*a*. Then, ink is preliminarily ejected from the recording head 31 to the heater 39 thus heated.

When the preliminarily ejected ink deposits on the heater 39, a liquid component of the ink such as water and the like is evaporated in a very short time and discharged into the atmosphere as vapor from an upper portion of the preliminary ejection receiver 38. In contrast, a solid component of the ink is firmly fixed on a surface of the heater 39.

To remove the solid component fixed on the surface of the heater 39, first, the carriage 33 is moved from below the preliminary ejection receiver 38. Subsequently, the cleaner 40 is moved upward by rotating the gear 41 in a direction "a" shown in FIG. 14 so as to cause the cleaner head 40*a* to come into contact with the heater 39. Then, the cleaner head 40*a* is minutely oscillated upward and downward by alternately rotating the gear 41 forward and backward little by little, thereby scraping off the solid component firmly fixed on the surface of the heater 39. Upon completion of cleaning of the heater 39, the cleaner 40 is moved to an original lower position by rotating the gear 41 in a direction "b" in FIG. 14.

As described above, according to the recording apparatus of the example, the ink preliminarily ejected into the preliminary ejection receiver 38 can be rapidly dried, which prevents the ink from dropping downward from the preliminary ejection receiver 38 later. Further, since no ink drops downward from the preliminary ejection receiver 38, it is not necessary to dispose a waste ink absorption body or the like in the recording apparatus, whereby the recording apparatus can be simply arranged and a size thereof can be reduced.

A liquid component of ink used in the example is mainly composed of water, and an amount of preliminarily ejected ink is about 0.02 g (0.02 [g/sec]×1 [sec]=0.02 [g]); however, the amount depends on temperature and humidity in an environment in which the recording apparatus is placed, down time, and recording mode. The energy necessary to completely vaporize this amount of the water of the ink is about 60 J. When the efficiency of the heater 39, and the like, are taken into consideration, it is contemplated that power of at least about 100 W is necessary. The heater 39 used in the example has a capacity of 200 W. In this case, no water of the ink remains in the preliminary ejection receiver 38 even if a maximum recording mode is employed.

Note that while a case in which the single recording head 31 is mounted on the carriage 33 has been described in this example, the recording apparatus of the present invention is not limited thereto, and four recording heads 31, for example, black, yellow, magenta, and cyan may be mounted on the carriage 33.

SEVENTH EXAMPLE

Figure 16:
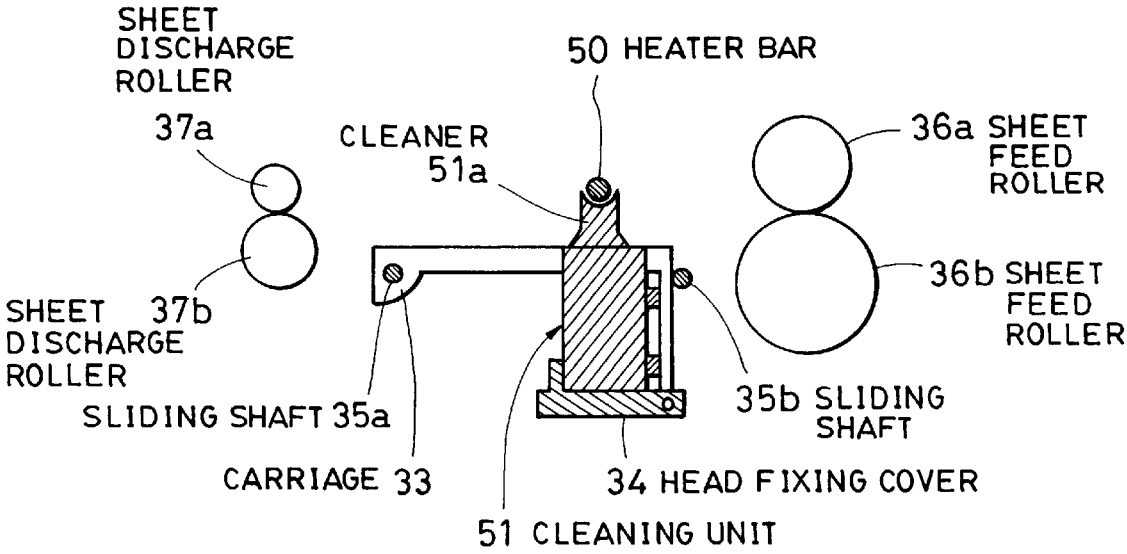
FIG. 16 is a sectional view showing a seventh example of the preliminary ejection receiver and the head unit.

FIG. 16 is a sectional view showing a main portion of a seventh example of the inkjet recording apparatus of the present invention. Note that since a carriage 33, a head fixing cover 34, sliding shafts 35*a* and 35*b*, sheet feed rollers 36*a* and 36*b*, and sheet discharge rollers 37*a* and 37*b* of the inkjet recording apparatus of the example are arranged and operated similarly to those of the inkjet recording apparatus described with reference to FIG. 14, detailed description thereof is omitted.

This example includes a heater bar 50 as a heat generating unit in place of the preliminary ejection receiver 38 containing the heater 39 (refer to FIG. 14). The heater bar 50 extends over a moving region of the carriage 33 and is disposed at a position where it faces an ink ejecting port surface of a recording head so as to be in parallel with the sliding shafts 35*a* and 35*b*. Further, heater wiring (not shown) is connected to both ends of the heater bar 50, and the heater bar 50 generates heat by being energized through the wiring.

In the above-mentioned arrangement in which ink is preliminarily ejected into the preliminary ejection receiver 38 containing the heater 39, since ink is ejected so as to concentrate on a single point of the heater 39, there is a possibility that when ink is continuously ejected, it exceeds a capacity of the heater 39 for evaporating water contained in the ink and the ink ejected into the preliminary ejection receiver 38 drops therefrom. In this example, however, since a region of the heater bar 50 for receiving preliminarily ejected ink extends over the moving region of the carriage 33, which permits ink to be preliminarily ejected to the heater bar 50 while scanning the recording head. As a result, even if ink is continuously ejected, since water of the ink is sequentially evaporated instantly on a surface of the heater bar 50, no insufficient evaporation of ink is caused.

Further, since the heater bar 50 receives preliminarily ejected ink in a wide region, a solid component of ink dispersingly deposits on the surface of the heater bar 50 in a lengthwise direction. As a result, the number of times of cleaning of the heater bar 50 can be reduced as compared with the sixth example.

In the recording apparatus of the example, when the heater bar 50 is cleaned, a cleaning unit 51 is mounted at a position of the carriage 33 where the recording head is mounted in place of it. The cleaning unit 51 includes a cleaner 51*a* which comes into contact with the heater bar 50 when it is mounted on the carriage 33.

A solid component of ink deposited on the heater bar 50 is removed by the cleaner 51*a* by reciprocating the carriage 33 along the sliding shafts 35*a* and 35*b* in a state in which the cleaning unit 51 is mounted on the carriage 33.

Further, generation of heat from the heater bar 50 not only in a preliminarily ejecting operation but also in an image recording operation permits a medium to be recorded to be heated from a back surface of a recording surface thereof in the image recording operation. With this operation, water of ink deposited on the recording surface can be rapidly dried, whereby a fixing time of the ink to the medium to be recorded can be reduced.

As described above, the inkjet recording apparatus of the present invention includes the heat generation unit for evaporating a liquid component of ink which is preliminarily ejected from the recording head and deposited thereon. Accordingly, the inkjet recording apparatus can prevent ink from dropping downward from the preliminary ejection receiver, whereby the recording apparatus can be simply arranged and a size thereof can be reduced.

EIGHTH EXAMPLE

Figure 17:
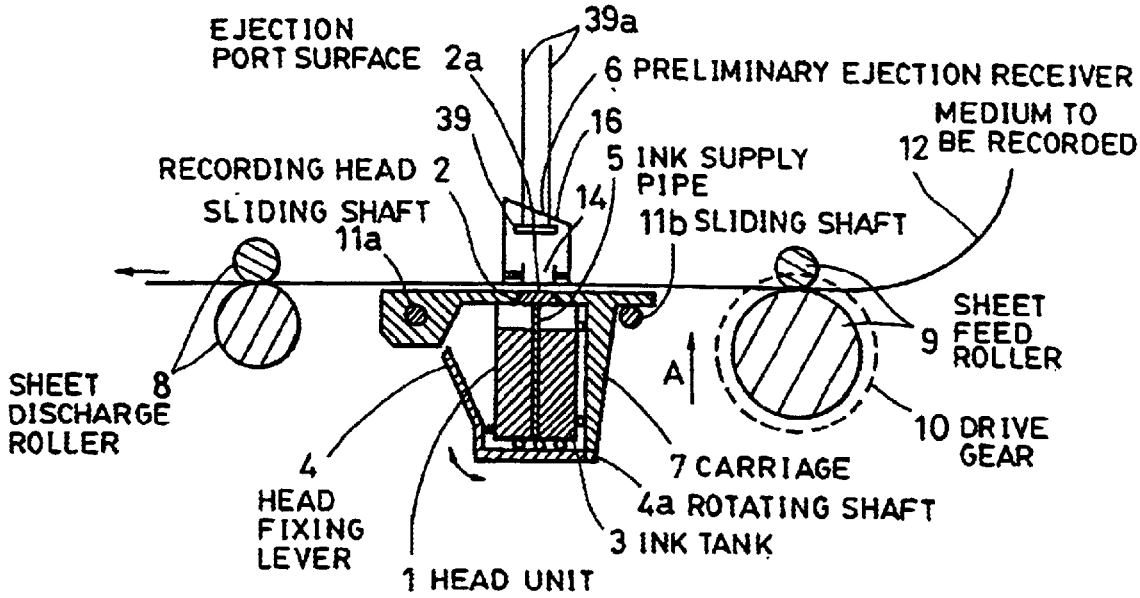
FIG. 17 is a sectional view showing an eighth example of the preliminary ejection receiver and the head unit.

FIG. 17 shows an eighth example. This example is arranged by combining the arrangement of the heater of the inkjet recording apparatus shown in the example 6 explained using FIG. 14 with the arrangement of the inkjet recording apparatus shown by the first example 1 explained using FIG. 2.

Explanation of the respective apparatuses is the same as that of the first and sixth examples explained using FIGS. 2 and 14.

As shown in FIG. 17, a carriage 7, on which a head unit 1 is mounted, is disposed below a transportation path, which is composed of sheet feed rollers 9 and sheet discharge rollers 8 (which will be described later), for a medium 12, with the head unit 1 composed of a recording head 2 and an ink tank 3 for accommodating ink to be supplied to the recording head 2. The head unit 1 is mounted on the carriage 7 with an ink ejecting port surface 2*a* facing upward so as to form an image on a medium 12 by ejecting ink onto a lower surface of the medium 12.

The carriage 7 is supported by two sliding shafts 11*a* and 11*b* and reciprocated by a carriage drive motor (not shown) through a timing belt (not shown) in a direction (vertical to the figure) normal to a direction in which the medium 12 is transported (right to left in the figure). A head fixing lever 4, which is rotatable about a rotating shaft 4*a*, is disposed with respect to the carriage 7 so that the head unit 1 can be mounted on the carriage 7 accurately by fixing it to the carriage 7 while rotating it.

The two sliding shafts 11*a* and 11*b* support the carriage 7 and determine a scanning direction thereof as well as regulate a distance between the ink ejecting port surface 2*a* of the recording head 2 and the medium 12 facing the surface 2*a* to permit an image of high accuracy to be formed on the medium 12.

As the carriage 7 moves, the inkjet recording apparatus creates an image for each scan on a lower surface of the medium 12 by ejecting ink from the recording head 2 during movement of the recording head 2 while alternately repeating reciprocating movement of the recording head 2 and transportation of the medium 12 at a predetermined pitch.

A pair of the sheet feed rollers 9, which constitute a transportation unit for transporting the medium 12, are disposed upstream of the carriage 7 with respect to a transporting direction of the medium 12. The medium 12 is supplied to the sheet feed rollers 9 from an auto sheet feeder (not shown) or a cassette (not shown) mounted on the recording apparatus. The sheet feed rollers 9 are driven by a drive unit (not shown) through a drive gear 10.

A guide member (not shown) is disposed downstream of the sheet feed rollers 9 with respect to the transporting direction of the medium 12. The guide member prevents the ink ejecting port surface 2*a* from coming into contact with the medium 12 by preventing floating and twisting of the medium 12 at a position where it faces the ink ejecting port surface 2*a* as well as keeps a distance between the ink ejecting port surface 2*a* and the lower surface of the medium 12 constant, thereby maintaining a position where ink reaches the medium 12 at a high degree of precision.

A pair of the sheet discharge rollers 8 are disposed downstream of the carriage 7 with respect to the transporting direction of the medium 12. After the medium 12 reaches the sheet discharge rollers 8, it is transported further, mainly by the sheet discharge rollers 8, and the medium 12, on which an image is created by the recording head 2, is discharged to the outside of the recording apparatus.

The head 2 is provided with a heater that is supplied with current through heater wiring 39*a*. The heater 39 in FIG. 17 operates like the heater 39 in FIGS. 14 and 15.

The combination of these two arrangements can achieve an arrangement of a preliminary ejection receiver having higher reliability because the recording apparatus of the eighth example can evaporate ink, in addition to an effect that ink is difficult to leak to the outside of a preliminary ejection receiver structurally.

Note that while the above examples have been described assuming that ink is ejected from the inkjet recording head in the vertically upward direction, the present invention is not necessarily limited thereto, and the arrangement of the present invention can be effectively used even in a case in which an ink ejecting direction is inclined by a predetermined angle $\theta$ ($\leqq 90°$) from the vertically upward direction along the gravity direction.

That is, while ink droplets ejected obliquely upward fly into the preliminary ejection receiver from the opening thereof, such circumstances that the flying ink directly leaks from the opening to the outside can be avoided because a flying direction of the ink droplets is apart from the opening of the preliminary ejection receiver with respect to a horizontal direction.

However, when a large amount of preliminarily ejected ink is accumulated, it overflows from the preliminary ejection receiver. Accordingly, an inkjet recording apparatus having a preliminary ejection receiver having high reliability can be provided by employing structures of the above-mentioned examples.

While the present invention has been described with reference to what are presently considered to be the preferred examples, it is to be understood that the invention is not limited to the disclosed examples. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus comprising:

an ink receiver configured to receive ink ejected in a preliminary ink ejection process that is executed to maintain and recover ink ejection performance of a recording head that is configured to eject ink in a vertically or obliquely upward direction against a direction of gravity to record an image on a medium, the ink receiver comprising:

an opening that acts as an inlet for the ink ejected into said ink receiver; and an ink leakage prevention structure that prevents the ink ejected into said ink receiver from leaking from said opening to the outside of said ink receiver in the direction of gravity, wherein said ink leakage prevention structure comprises a ceiling surface that, at least during the preliminary ink ejection process, faces an ink ejecting portion of the recording head, with a distance d from the ink ejecting portion to said ceiling surface satisfying the following inequality:

$$d < \frac{mv_o}{6\pi\eta\sqrt[3]{\frac{3m}{4\pi\rho}}}$$

where m represents a mass of an ink droplet ejected from the recording head, $v_0$ represents an ejection velocity of the ink droplet, ρ represents a density of the ink droplet, and η represents a viscosity resistance of air, and values employed for d, m, $v_0$, ρ and η are all expressed in units of the same system of measurement.

2. An inkjet recording apparatus according to claim 1, wherein said ceiling surface inclines with respect to a horizontal direction, and an end of said ceiling surface closest to the recording head extends beyond an area of projection of the recording head.

3. An inkjet recording apparatus according to claim 1, wherein a plurality of grooves are formed on said ceiling surface along the inclining direction of said ceiling surface.

4. An inkjet recording apparatus according to claim 1, wherein a projection projecting upward is disposed around an edge of said opening of said ink receiver.

5. An inkjet recording apparatus according to claim 4, wherein an ink absorption body is disposed around said edge of said opening of said ink receiver.

6. An inkjet recording apparatus according to claim 5, wherein said ink receiver comprises an ink discharge unit for discharging ink accommodated therein, and said ink absorption body is continuously formed in said ink receiver and said ink discharge unit.

7. An inkjet recording apparatus according to claim 1, further comprising a carriage on which the recording head is mounted and which is scanned with respect to the medium, wherein said ink receiver is disposed at a position which is located outside of a region where an image can be recorded on the medium and which faces an ink ejecting port surface of the recording head when the recording head is moved into position by said carriage.

8. An inkjet recording apparatus according to claim 7, wherein said ink receiver:

comprises a heat generating means that extends over a scanning range of said carriage along a scanning direction thereof, is disposed at a position facing the ink ejecting port surface of the recording head, and evaporates a liquid component of the ink ejected from the recording head and deposited on said heat generating means.

9. An inkjet recording apparatus according to claim 1, wherein said ink receiver comprises heat generating means for evaporating a liquid component of the ink ejected from the recording head and deposited on said heat generating means.

10. An inkjet recording apparatus according to claim 9, further comprising cleaning means for removing a solid component of the ink that remains firmly fixed on a surface of said heat generating means after the liquid component of the ink deposited on said heat generating means has been evaporated.

11. An inkjet recording apparatus according to claim 9 or 8, wherein the heat generating means comprises a heater that generates heat when it is energized.

12. An inkjet recording apparatus comprising:

an ink receiver configured to receive ink ejected in a preliminary ink ejection process that is executed to maintain and recover ink ejection performance of a recording head that is configured to eject ink in a vertically or obliquely upward direction against a direction of gravity to record an image on a medium, wherein, at least during the preliminary ink ejection process, said ink receiver faces the recording head and the recording head and said ink receiver are aligned so as to form an angle less than 90° from the vertically upward direction which is the direction opposite the direction of gravity.

13. An inkjet recording apparatus according to claim 12, wherein the preliminarily ejected ink reaches said ink receiver through an opening of said ink receiver that acts as an ink inlet and reaches the outside of said ink receiver at a space that extends into said ink receiver in a direction opposite to the direction of gravity.

14. An inkjet recording apparatus according to claim 12, wherein said ink receiver comprises a ceiling surface that inclines with respect to a horizontal direction, and an end of said ceiling surface closest to the recording head extends beyond an area of projection of the recording head.

15. An inkjet recording apparatus according to claim 14, wherein a plurality of grooves are formed on said ceiling surface along the inclining direction of said ceiling surface.

16. An inkjet recording apparatus according to claim 12, wherein a projection projecting upward is disposed around an edge of an opening of said ink receiver.

17. An inkjet recording apparatus according to claim 16, wherein an ink absorption body is disposed around said edge of said opening of said ink receiver.

18. An inkjet recording apparatus according to claim 17, wherein said ink receiver comprises an ink discharge unit for discharging ink accommodated therein, and said ink absorption body is continuously formed in said ink receiver and said ink discharge unit.

19. An inkjet recording apparatus according to claim 12, further comprising a carriage on which the recording head is mounted and which is scanned with respect to the medium, wherein said ink receiver is disposed at a position which is located outside of a region where an image can be recorded on the medium and which faces an ink ejecting port surface of the recording head when the recording head is moved into position by said carriage.

20. An inkjet recording apparatus according to claim 12, wherein said ink receiver comprises heat generating means for evaporating a liquid component of the ink ejected from the recording head and deposited on said heat generating means.

21. An inkjet recording apparatus according to claim 20, further comprising cleaning means for removing a solid component of the ink that remains firmly fixed on a surface of said heat generating means after the liquid component of the ink deposited on said heat generating means has been evaporated.

22. An inkjet recording apparatus comprising:

an ink receiver configured to receive ink ejected in a preliminary ink ejection process that is executed to maintain and recover ink ejection performance of a recording head that is configured to eject ink in a vertically or obliquely upward direction against a direction of gravity to record an image on a medium, the ink receiver comprising:

an opening that acts as an inlet for the ink ejected into said ink receiver; and a ceiling surface that, at least during the preliminary ink ejection process, faces an ink ejecting portion of the recording head, said ceiling surface being configured to stop the ink ejected into said ink receiver and to direct the ink away to prevent leaking from said opening to the outside of said ink receiver, wherein, at least during the preliminary ink ejection process, a distance d from the ink ejecting portion to said ceiling surface satisfies the following inequality:

$$d < \frac{mv_o}{6\pi\eta\sqrt[3]{\frac{3m}{4\pi\rho}}}$$

where m represents a mass of an ink droplet ejected from the recording head, $v_0$ represents an ejection velocity of the ink droplet, ρ represents a density of the ink droplet, and η represents a viscosity resistance of air, and values employed for d, m, $v_0$, ρ and η are all expressed in units of the same system of measurement.

23. An inkjet recording apparatus comprising:

an ink receiving means for receiving ink ejected in a preliminary ink ejection process that is executed to maintain and recover ink ejection performance of a recording head that is configured to eject ink in a vertically or obliquely upward direction against a direction of gravity to record an image on a medium, the ink receiver comprising:

an inlet means for allowing entry of the ink ejected into said ink receiver; and an ink leakage prevention means for preventing the ink ejected into said ink receiver from leaking from said inlet means, wherein said ink leakage prevention means comprises a ceiling surface that, at least during the preliminary ink ejection process, faces an ink ejecting portion of the recording head, with a distance d from the ink ejecting portion to said ceiling surface satisfying the following inequality:

$$d < \frac{mv_o}{6\pi\eta\sqrt[3]{\frac{3m}{4\pi\rho}}}$$

where m represents a mass of an ink droplet ejected from the recording head, $v_0$ represents an ejection velocity of the ink droplet, ρ represents a density of the ink droplet, and η represents a viscosity resistance of air, and values employed for d, m, $v_0$, ρ and η are all expressed in units of the same system of measurement.

* * * * *